US008369536B2

(12) United States Patent
Kim et al.

(10) Patent No.: US 8,369,536 B2
(45) Date of Patent: Feb. 5, 2013

(54) SOUND SYSTEM, SOUND REPRODUCING APPARATUS, SOUND REPRODUCING METHOD, MONITOR WITH SPEAKERS, MOBILE PHONE WITH SPEAKERS

(75) Inventors: Yang-Hann Kim, Daejeon (KR); Joung-Woo Choi, Yongin (KR); Ji-Ho Chang, Daejeon (KR); Jin-Young Park, Daejeon (KR); Chan-Hui Lee, Ulsan (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 343 days.

(21) Appl. No.: 12/671,493

(22) PCT Filed: Nov. 13, 2008

(86) PCT No.: PCT/KR2008/006691

§ 371 (c)(1),
(2), (4) Date: Jan. 29, 2010

(87) PCT Pub. No.: WO2009/096657

PCT Pub. Date: Aug. 6, 2009

(65) Prior Publication Data

US 2010/0284544 A1 Nov. 11, 2010

(30) Foreign Application Priority Data

Jan. 29, 2008 (KR) ..... 10-2008-0008874

(51) Int. Cl.
*H04R 1/40* (2006.01)

(52) U.S. Cl. ..... 381/97; 381/56; 381/57; 381/101; 381/89

(58) Field of Classification Search ..... 381/91–92, 381/122, 1, 17–18, 306–307, 97, 89, 98–99, 381/77–79, 56–57, 101
See application file for complete search history.

(56) References Cited

U.S. PATENT DOCUMENTS
(Continued)

FOREIGN PATENT DOCUMENTS

| | | | |
|---|---|---|---|
| EP | 1 545 154 | A2 | 6/2005 |
| JP | H08-221081 | A | 8/1996 |

(Continued)

OTHER PUBLICATIONS

R. C. Jones, 'On the theory of the directional patterns of continuous source distributions on a plane surface,' J. Acoust. Soc. Am.16(3), pp. 147-171, 1945, USA.

(Continued)

*Primary Examiner* — Disler Paul
(74) *Attorney, Agent, or Firm* — Global IP Counselors, LLP

(57) ABSTRACT

An apparatus for reproducing sound from original source signals has a control device, a first speaker, and a second speaker. The control device receives first and second original source signals, and controls magnitudes and phases of the received first and second original source signals so that a sound pressure level in a pre-determined zone is higher than a sound pressure level in a zone other than the pre-determined zone, and outputs first and second controlled source signals. The first speaker receives the first controlled source signal and reproduces sound. The second speaker receives the second controlled source signal and reproduces sound. The apparatus according provides a sound environment in which only the person using the sound system enjoys the sound.

24 Claims, 13 Drawing Sheets

U.S. PATENT DOCUMENTS

| | | | | |
|---|---|---|---|---|
| 2,043,416 | A | 6/1936 | Lueg | |
| 5,604,809 | A | 2/1997 | Tsubonuma et al. | |
| 5,802,190 | A | 9/1998 | Ferren | |
| 5,910,990 | A | 6/1999 | Jang | |
| 7,623,114 | B2 * | 11/2009 | Rank | 345/156 |
| 7,840,019 | B2 * | 11/2010 | Slaney et al. | 381/303 |
| 7,970,144 | B1 * | 6/2011 | Avendano et al. | 381/1 |
| 8,280,076 | B2 * | 10/2012 | Devantier et al. | 381/99 |
| 2003/0031333 | A1 | 2/2003 | Cohen et al. | |
| 2008/0101631 | A1 * | 5/2008 | Jung et al. | 381/307 |
| 2010/0189282 | A1 * | 7/2010 | Bharitkar et al. | 381/97 |

FOREIGN PATENT DOCUMENTS

| | | | |
|---|---|---|---|
| JP | 2000-333289 | A | 11/2000 |
| JP | 2001-092469 | A | 4/2001 |
| JP | 2003-230190 | A | 8/2003 |
| JP | 2007-243772 | A | 9/2007 |
| KR | 1020030003694 | A | 1/2003 |
| KR | 1020050013323 | A | 2/2005 |
| KR | 1020050060789 | A | 6/2005 |

OTHER PUBLICATIONS

R. L. Prichard, 'Maximum directivity index of a linear point array,' J. Acoust. Soc. Am. 26, pp. 1034-1039, 1954, USA.

C. L. Dolph, 'A current distribution for broadside arrays which optimizes the relationship between beam width and side-lobe level,' Proc. IRE 34(6), pp. 335-348, 1946.

Roy L. Streit, 'Optimization of discrete array of arbitrary geometry,'J. Acost. Soc. Am. 69(1), pp. 199-212, 1981, USA.

* cited by examiner

SOUND SYSTEM, SOUND REPRODUCING APPARATUS, SOUND REPRODUCING METHOD, MONITOR WITH SPEAKERS, MOBILE PHONE WITH SPEAKERS

CROSS-REFERENCE TO RELATED APPLICATIONS

This U.S. National stage application claims priority under 35 U.S.C. §119(a) to Korean Patent Application No. 10-2008-0008874, filed in the Republic of Korea on Jan. 29, 2008, the entire contents of which are hereby incorporated herein by reference.

BACKGROUND OF THE INVENTION

1. Field of the Invention

The present invention relates to an apparatus for reproducing sound, a method for reproducing sound, a monitor with speakers, and a mobile phone with speakers.

2. Background Information

Sound field control technology using a plurality of sound sources has been generally developed in order to improve the acoustic characteristics at some designated positions in space. However, recently, technology has been developing to improve the acoustic characteristics of a specific zone (i.e. where a listener exists). Sound field control technology using a plurality of sound sources can be categorized into two groups in general. One is an active noise control that reduces sound level of a zone by changing the magnitude/phase input to a plurality of sound sources actively. The other is a control that increases the emitted sound power for a specific angle by changing a gap between sources that are arranged in a specific shape [R. C. Jones, "On the theory of the directional patterns of continuous source distributions on a plane surface," J. Acoust. Soc. Am.16(3), 147-1710 945)] or by changing the time delay and magnitude input between each sound source [R. L. Prichard, "Maximum directivity index of a linear point array," J. Acoust. Soc. Am. 26, 1034-1039(1954)]. The latter was studied for the active sonar. As representative, Dolph has proposed a mathematical solution having a weight function of a sound source array that generates a sidelobe of constant magnitude so that the emitted acoustic power at a specific directional angle is not affected by the sidelobe [C. L. Dolph, "A current distribution for broadside arrays which optimizes the relationship between beamwidth and sidelobe level," Proc. IRE 34(6), 335-348 (1946)].

But, it was difficult to apply in the case of an arbitrary source array because it was the mathematical solution for a specific source array. So, the optimization technique for getting maximum emitted sound power to a specific direction in the case of an arbitrary sound source array has been studied by Streit [Roy L. Streit, "Optimization of discrete array of arbitrary geometry," J. Acost. Soc. Am. 69(1), 199-212 (1981)]. However, this research assumed only an arbitrary sound source array and is not suitable for applying to a common listening space that reflects several acoustic phenomena due to various radiation patterns of sources, reflection/absorption of walls and etc.

The technology controlling sound pressure level in the space where the listener exists has been studied as active noise control [P. Lueg 1936 Process of silencing sound oscillations. U.S. Pat. No. 2,043,416], which is not same with the research optimizing the emission pattern.

The active noise control is a noise reduction method by actively controlling acoustic potential energy or sound power generated by background noise source using second sound sources. It is effective to obtain the silence against the listener or the total space in low frequency range. In this case, the space where the silence is successively gotten by controlling noise is called a quiet zone.

Further, the technology controlling indirect characteristics like directionality by using restrictive assumption that is neglecting the distance to the listener or reflection and the like is known to all by U.S. Pat. No. 5,802,190 (Linear speaker array). The method of reproducing a signal without distortion by using transfer function is also known to all by U.S. Pat. No. 5,910,990 (Apparatus and method for automatic equalization of personal multi-channel audio system).

Consequently, the conventional sound field control methods using a plurality of sound sources are mainly originated by changing the time delay between sound sources and the input magnitude simply, or changing the directionality of emitted sound power by using a restrictive array type of sound source without considering the variable location of the listener or the space where the listener exists. Also, there is the problem that it is not possible to reflect the acoustic characteristics of the listening space due to radiation, reflection, absorption, and so on, because the conventional methods only assume free field condition.

SUMMARY OF THE INVENTION

An object of the present invention is to enlarge the relative sound pressure level difference between each zone of acoustic space.

Another object of the present invention is to enlarge not only the magnitude of sound pressure level corresponding to acoustical brightness but also the ratio of sound pressure level between two zones corresponding to acoustical contrast.

Further to the above objects, the present invention has additional technical objects not described above, which can be clearly understood by those skilled in the art through the following description.

An apparatus according to a first aspect of the present invention is an apparatus for reproducing sound from original source signals, and includes a control means, a first speaker, and a second speaker. The control means receives first and second original source signals, and controls magnitudes and phases of the received first and second original source signals so that a contrast between spatially averaged acoustic energy in a pre-determined zone and a sum of energies of the first and second original source signals is maximized, and outputs first and second controlled source signals. The first speaker receives the first controlled source signal and reproduces sound. The second speaker receives the second controlled source signal and reproduces sound.

In the apparatus according to the first aspect of the present invention, the control means receives original source signals, controls magnitudes and phases of the received original source signals so that a contrast between spatially averaged acoustic energy in a pre-determined zone (that is, audible zone) and sum of energies of the first and second original source signals (that is, total magnitude of input) is maximized for outputting first and second controlled source signals, and outputs controlled source signals.

Here, only the first speaker and the second speaker are described, but this shows only the order of the speakers, so this is not limited to only two speakers. Practically, it is realized by the array of speakers. The relative position between a sound system and a listener who uses the sound system may be changed. A person who does not use the sound system does not need to listen to the sound reproduced by the sound system. So, the present invention generates an audible zone and an inaudible zone by controlling magnitudes and phases of original source signals so that a sound pressure level in a zone in which the listener using the sound system exists, that is, a zone that is selected as audible zone, is higher than a sound pressure level in a zone other than the zone, that is, the zone in which the listener does not exist.

Accordingly, the apparatus according to the first aspect of the present invention can make a sound pressure level of a zone in which the listener exists, that is, a zone that is selected as an audible zone, higher than a sound pressure level of a zone in which the listener does not exist, that is, a zone other than the audible zone. Thus, the apparatus can provide a sound environment in which only the person using the sound system enjoys the sound.

An apparatus according to a second aspect of the present invention is an apparatus for reproducing sound, and includes a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and sum of energies of the first and second original source signals is maximized.

The apparatus according to the second aspect of the present invention maximizes a contrast between spatially averaged acoustic energy in a pre-determined zone and sum of energies of the first and second original source signals by inputting source signals whose magnitudes and phases have been controlled to the speakers. The front pre-determined zone is the ordinary position of the user of the sound system. For example, if the sound system is a normal sized television, the front pre-determined zone might be a zone with about 1~2 m distance from the normal sized television, and if the sound system is a mini sized television, the front pre-determined zone might be a zone with about 20~40 cm distance from the mini sized television, but it is not limited to this. In order that the contrast between spatially averaged acoustic energy in the pre-determined zone and sum of energies of the first and second original source signals is maximized, the source signals whose magnitudes and phases have been controlled are inputted to the speakers, so a sound pressure level in the front pre-determined zone becomes bigger than a sound pressure level in a zone other than the front pre-determined zone (that is, inaudible zone).

Accordingly, the apparatus according to the second aspect of the present invention can provide a sound environment in which only the person using the sound system enjoys the sound.

A monitor according to a third aspect of the present invention is a monitor with speakers, and is fitted with a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and sum of energies of the first and second original source signals is maximized.

The monitor with speakers according to the third aspect of the present invention maximizes a contrast between spatially averaged acoustic energy in a pre-determined zone and sum of energies of the first and second original source signals by inputting source signals whose magnitudes and phases have been controlled to the speakers. The front pre-determined zone is the ordinary position of the user of the monitor. For example, if the monitor is an ordinary computer monitor, the front pre-determined zone might be a zone with about 30~50 cm distance from the computer monitor, but it is not limited to this. In order that the contrast between spatially averaged acoustic energy in the pre-determined zone and sum of energies of the first and second original source signals is maximized, the source signals whose magnitudes and phases have been controlled are inputted to the speakers, so a sound pressure level in the front pre-determined zone becomes bigger than a sound pressure level in a zone other than the front pre-determined zone.

Accordingly, the monitor with speakers according to the third aspect of present invention can provide a sound environment in which only the person using the sound system enjoys the sound.

A mobile phone according to a fourth aspect of the present invention is a mobile phone with speakers, and is fitted with a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and sum of energies of the first and second original source signals is maximized.

The mobile phone with speakers according to the fourth aspect of the present invention maximizes a contrast between spatially averaged acoustic energy in a pre-determined zone and sum of energies of the first and second original source signals by inputting source signals whose magnitudes and phases have been controlled to the speakers. The front pre-determined zone is the ordinary position of the user of the mobile phone. For example, if the mobile phone is an ordinary mobile phone, the front pre-determined zone might be a zone with about 5~20 cm distance from the mobile phone screen, but it is not limited to this. In order that the contrast between spatially averaged acoustic energy in the pre-determined zone and sum of energies of the first and second original source signals is maximized, the source signals whose magnitudes and phases have been controlled are inputted to the speakers, so a sound pressure level in the front pre-determined zone becomes bigger than a sound pressure level in a zone other than the front pre-determined zone.

Accordingly, the mobile phone with speakers according to the fourth aspect of the present invention can provide a sound environment in which only the person using the sound system enjoys the sound.

An apparatus according to a fifth aspect of the present invention is an apparatus for reproducing sound from source signals, and includes a sound generating unit, a sensing unit, a signal analyzing unit, and a signal generating unit. The sound generating unit is for receiving source signals and reproducing sound, and has a plurality of speakers and a multi-channel audio amplifier which drives the plurality of speakers. The sensing unit is for sensing sound signals from the sound generating unit, and has a plurality of microphones, at least one of the microphones being installed in a pre-determined zone and another of the microphones being installed in a zone other than the pre-determined zone. The signal analyzing unit has a multi-channel signal analyzer that calculates a transfer function between the source signals received by the sound generating unit and the sound signals sensed by the sensing unit, and determines magnitudes and phases of the source signals received by the sound generating unit by using the transfer function so that a contrast between spatially averaged acoustic energy in a pre-determined zone and sum of energies of the first and second original source signals is maximized. The signal generating unit has a multi-channel signal generator that receives information about the magnitudes and phases of the source signals being determined by the signal analyzing unit, generates a synchronized individual controlled source signals and transfers the synchronized individual controlled source signals to the plurality of speakers.

Accordingly, the apparatus according to the fifth aspect of the present invention can generate an audible zone and an inaudible zone, and provide a sound environment in which only the person using the sound system enjoys the sound.

A method according to a sixth aspect of the present invention is a method for reproducing sound, and includes the steps of: Calculating a transfer function between source signals inputted to speaker and sound signals sensed in a pre-determined zone; Determining magnitudes and phases of the source signals by using the transfer function so that a contrast between spatially averaged acoustic energy in a pre-determined zone and sum of energies of the first and second original source signals is maximized; and Reproducing sound by generating the source signals according to the determined magnitudes and phases and inputting the generated source signals to the speakers.

Accordingly, the apparatus according to the sixth aspect of the present invention can generate an audible zone and an inaudible zone, and provide a sound environment in which only the person using the sound system enjoys the sound.

An apparatus according to a seventh aspect of the present invention is an apparatus for reproducing sound from original source signals, and includes a control means, a first speaker, and a second speaker. The control means receives first and second original source signals, and controls magnitudes and phases of the received first and second original source signals so that a contrast between spatially averaged acoustic energy in a pre-determined zone and spatially averaged acoustic energy in a zone other than the pre-determined zone is maximized, and outputs first and second controlled source signals. The first speaker receives the first controlled source signal and reproduces sound. The second speaker receives the second controlled source signal and reproduces sound.

In the apparatus according to the seventh aspect of the present invention, the control means receives original source signals, and controls magnitudes and phases of the received original source signals so that a contrast between spatially averaged acoustic energy in a pre-determined zone (that is, audible zone) and spatially averaged acoustic energy in a zone other than the pre-determined zone (that is, inaudible zone) is maximized and outputting first and second controlled source signals, and outputs controlled source signals.

Here, only the first speaker and the second speaker are described, but this shows only the order of the speakers, so this is not limited to only two speakers. Practically, it is realized by the array of speakers. The relative position between a sound system and a listener who uses the sound system may be changed. A person who does not use the sound system does not need to listen to the sound reproduced by the sound system. So, the present invention generates an audible zone and an inaudible zone by controlling magnitudes and phases of original source signals so that a sound pressure level in a zone in which the listener using the sound system exists, that is, a zone that is selected as an audible zone, is higher than a sound pressure level in a zone other than the zone, that is, the zone in which the listener does not exist.

Accordingly, the apparatus according to the seventh aspect of the present invention can make a sound pressure level of a zone in which the listener exists, that is, a zone that is selected as an audible zone, higher than a sound pressure level of a zone in which the listener does not exist, that is, a zone other than the audible zone. Thus, the apparatus can provide a sound environment in which only the person using the sound system enjoys the sound.

An apparatus according to an eighth aspect of the present invention is an apparatus for reproducing sound, and includes a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and spatially averaged acoustic energy in a zone other than the pre-determined zone is maximized.

The apparatus according to the eighth aspect of the present invention maximizes the contrast between spatially averaged acoustic energy in the pre-determined zone and spatially averaged acoustic energy in a zone other than the pre-determined zone by inputting source signals whose magnitudes and phases have been controlled to the speakers. The front pre-determined zone is the ordinary position of the user of the sound system. For example, if the sound system is a normal sized television, the front pre-determined zone might be a zone with about 1~2 m distance from the normal sized television, and if the sound system is a mini sized television, the front pre-determined zone might be a zone with about 20~40 cm distance from the mini sized television, but it is not limited to this. In order that the contrast between spatially averaged acoustic energy in the pre-determined zone and spatially averaged acoustic energy in the zone other than the pre-determined zone is maximized, the source signals whose magnitudes and phases have been controlled are inputted to the speakers, so a sound pressure level in the front pre-determined zone becomes bigger than a sound pressure level in a zone other than the front pre-determined zone.

Accordingly, the apparatus according to the eighth aspect of the present invention can provide a sound environment in which only the person using the sound system enjoys the sound.

A monitor according to a ninth aspect of the present invention is a monitor with speakers, and is fitted with a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and spatially averaged acoustic energy in a zone other than the pre-determined zone is maximized.

The monitor with speakers according to the ninth aspect of the present invention maximizes a contrast between spatially averaged acoustic energy in a pre-determined zone and spatially averaged acoustic energy in a zone other than the pre-determined zone by inputting source signals whose magnitudes and phases have been controlled to the speakers. The front pre-determined zone is the ordinary position of the user of the monitor. For example, if the monitor is an ordinary computer monitor, the front pre-determined zone might be a zone with about 30~50 cm distance from the computer monitor, but it is not limited to this. In order that the contrast between spatially averaged acoustic energy in a pre-determined zone and spatially averaged acoustic energy in a zone other than the pre-determined zone is maximized, the source signals whose magnitudes and phases have been controlled are inputted to the speakers, so a sound pressure level in the front pre-determined zone becomes bigger than a sound pressure level in a zone other than the front pre-determined zone.

Accordingly, the monitor with speakers according to the ninth aspect of present invention can provide a sound environment in which only the person using the sound system enjoys the sound.

A mobile phone according to a tenth aspect of the present invention is a mobile phone with speakers, and is fitted with a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and spatially averaged acoustic energy in a zone other than the pre-determined zone is maximized.

The mobile phone with speakers according to the tenth aspect of the present invention maximizes a contrast between spatially averaged acoustic energy in a pre-determined zone and spatially averaged acoustic energy in a zone other than the pre-determined zone by inputting source signals whose magnitudes and phases have been controlled to the speakers. The front pre-determined zone is the ordinary position of the user of the mobile phone. For example, if the mobile phone is an ordinary mobile phone, the front pre-determined zone might be a zone with about 5~20 cm distance from the mobile phone screen, but it is not limited to this. In order that the contrast between spatially averaged acoustic energy in a pre-determined zone and spatially averaged acoustic energy in a zone other than the pre-determined zone is maximized, the source signals whose magnitudes and phases have been controlled are inputted to the speakers, so a sound pressure level in the front pre-determined zone becomes bigger than a sound pressure level in a zone other than the front pre-determined zone.

Accordingly, the mobile phone with speakers according to the tenth aspect of the present invention can provide a sound environment in which only the person using the sound system enjoys the sound.

An apparatus according to a eleventh aspect of the present invention is an apparatus for reproducing sound from source signals, and includes a sound generating unit, a sensing unit, a signal analyzing unit, and a signal generating unit. The sound generating unit is for receiving source signals and reproducing sound, and has a plurality of speakers and a multi-channel audio amplifier which drives the plurality of speakers. The sensing unit is for sensing sound signals from the sound generating unit, and has a plurality of microphones, at least one of the microphones being installed in a pre-determined zone and another of the microphones being installed in a zone other than the pre-determined zone. The signal analyzing unit has a multi-channel signal analyzer that calculates a transfer function between the source signals received by the sound generating unit and the sound signals sensed by the sensing unit, and determines magnitudes and phases of the source signals received by the sound generating unit by using the transfer function so that a contrast between spatially averaged acoustic energy in a pre-determined zone and spatially averaged acoustic energy in a zone other than the pre-determined zone is maximized. The signal generating unit has a multi-channel signal generator that receives information about the magnitudes and phases of the source signals being determined by the signal analyzing unit, generates a synchronized individual controlled source signals, and transfers the synchronized individual controlled source signals to the plurality of speakers.

Accordingly, the apparatus according to the eleventh aspect of the present invention can generate an audible zone and an inaudible zone, and provide a sound environment in which only the person using the sound system enjoys the sound.

A method according to a twelfth aspect of the present invention is a method for reproducing sound, and includes the steps of: Calculating a transfer function between source signals inputted to a speaker and sound signals sensed in a pre-determined zone; Determining magnitudes and phases of the source signals by using the transfer function so that a contrast between spatially averaged acoustic energy in a pre-determined zone and spatially averaged acoustic energy in a zone other than the pre-determined zone is maximized; and Reproducing sound by generating the source signals according to the determined magnitudes and phases and inputting the generated source signals to the speakers.

Accordingly, the apparatus according to the twelfth aspect of the present invention can generate an audible zone and an inaudible zone, and provide a sound environment in which only the person using the sound system enjoys the sound.

An apparatus according to a thirteenth aspect of the present invention is an apparatus for reproducing sound from original source signals, and includes a control means, a first speaker, and a second speaker. The control means receives first and second original source signals, and controls magnitudes and phases of the received first and second original source signals so that a contrast between spatially averaged acoustic energy in a pre-determined zone and spatially averaged acoustic energy in total zone that includes the pre-determined zone and a zone other than the pre-determined zone is maximized, and outputs first and second controlled source signals. The first speaker receives the first controlled source signal and reproduces sound. The second speaker receives the second controlled source signal and reproduces sound.

In the apparatus according to the thirteenth aspect of the present invention, the control means receives original source signals, and controls magnitudes and phases of the received original source signals so that a contrast between spatially averaged acoustic energy in a pre-determined zone and spatially averaged acoustic energy in total zone that includes the pre-determined zone and a zone other than the pre-determined zone is maximized and outputting first and second controlled source signals, and outputs controlled source signals.

Here, only the first speaker and the second speaker are described, but this shows only the order of the speakers, so this is not limited to only two speakers. Practically, it is realized by the array of speakers. The relative position between a sound system and a listener who uses the sound system may be changed. A person who does not use the sound system does not need to listen to the sound reproduced by the sound system. So, the present invention generates an audible zone and an inaudible zone by controlling magnitudes and phases of original source signals so that a sound pressure level in a zone in which the listener using the sound system exists, that is, a zone that is selected as an audible zone, is higher than a sound pressure level in a zone other than the zone, that is, the zone in which the listener does not exist.

Accordingly, the apparatus according to the thirteenth aspect of the present invention can make a sound pressure level of a zone in which the listener exists, that is, a zone that is selected as an audible zone, higher than a sound pressure level of a zone in which the listener does not exist, that is, a zone other than the audible zone. Thus, the apparatus can provide a sound environment in which only the person using the sound system enjoys the sound.

An apparatus according to a fourteenth aspect of the present invention is an apparatus for reproducing sound, and includes a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and spatially averaged acoustic energy in total zone that includes the pre-determined zone and a zone other than the pre-determined zone is maximized.

The apparatus according to the fourteenth aspect of the present invention maximizes the contrast between spatially averaged acoustic energy in a pre-determined zone and spatially averaged acoustic energy in total zone that includes the pre-determined zone and a zone other than the pre-determined zone by inputting source signals whose magnitudes and phases have been controlled to the speakers. The front pre-determined zone is the ordinary position of the user of the sound system. For example, if the sound system is a normal sized television, the front pre-determined zone might be a zone with about 1~2 m distance from the normal sized television, and if the sound system is a mini sized television, the front pre-determined zone might be a zone with about 20~40 cm distance from the mini sized television, but it is not limited to this. In order that the contrast between spatially averaged acoustic energy in a pre-determined zone and spatially averaged acoustic energy in total zone that includes the pre-determined zone and a zone other than the pre-determined zone is maximized, the source signals whose magnitudes and phases have been controlled are inputted to the speakers, so a sound pressure level in the front pre-determined zone becomes bigger than a sound pressure level in a zone other than the front pre-determined zone.

Accordingly, the apparatus according to the fourteenth aspect of the present invention can provide a sound environment in which only the person using the sound system enjoys the sound.

A monitor according to a fifteenth aspect of the present invention is a monitor with speakers, and is fitted with a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and spatially averaged acoustic energy in total zone that includes the pre-determined zone and a zone other than the pre-determined zone is maximized.

The monitor with speakers according to the fifteenth aspect of the present invention maximizes a contrast between spatially averaged acoustic energy in a pre-determined zone and spatially averaged acoustic energy in total zone that includes the pre-determined zone and a zone other than the pre-determined zone by inputting source signals whose magnitudes and phases have been controlled to the speakers. The front pre-determined zone is the ordinary position of the user of the monitor. For example, if the monitor is an ordinary computer monitor, the front pre-determined zone might be a zone with about 30~50 cm distance from the computer monitor, but it is not limited to this. In order that the contrast between spatially averaged acoustic energy in a pre-determined zone and spatially averaged acoustic energy in total zone that includes the pre-determined zone and a zone other than the pre-determined zone is maximized, the source signals whose magnitudes and phases have been controlled are inputted to the speakers, so a sound pressure level in the front pre-determined zone becomes bigger than a sound pressure level in a zone other than the front pre-determined zone.

Accordingly, the monitor with speakers according to the fifteenth aspect of present invention can provide a sound environment in which only the person using the sound system enjoys the sound.

A mobile phone according to a sixteenth aspect of the present invention is a mobile phone with speakers, and is fitted with a first speaker for receiving a first controlled source signal and a second speaker for receiving a second controlled source signal, wherein magnitudes and phases of the first and the second controlled source signals have been controlled so that a contrast between spatially averaged acoustic energy in a pre-determined zone and spatially averaged acoustic energy in total zone that includes the pre-determined zone and a zone other than the pre-determined zone is maximized.

The mobile phone with speakers according to the sixteenth aspect of the present invention maximizes a contrast between spatially averaged acoustic energy in a pre-determined zone and spatially averaged acoustic energy in total zone that includes the pre-determined zone and a zone other than the pre-determined zone by inputting source signals whose magnitudes and phases have been controlled to the speakers. The front pre-determined zone is the ordinary position of the user of the mobile phone. For example, if the mobile phone is an ordinary mobile phone, the front pre-determined zone might be a zone with about 5~20 cm distance from the mobile phone screen, but it is not limited to this. In order that the contrast between spatially averaged acoustic energy in a pre-determined zone and spatially averaged acoustic energy in total zone that includes the pre-determined zone and a zone other than the pre-determined zone is maximized, the source signals whose magnitudes and phases have been controlled are inputted to the speakers, so a sound pressure level in the front pre-determined zone becomes bigger than a sound pressure level in a zone other than the front pre-determined zone.

Accordingly, the mobile phone with speakers according to the sixteenth aspect of the present invention can provide a sound environment in which only the person using the sound system enjoys the sound.

An apparatus according to a seventeenth aspect of the present invention includes the apparatus according to the first, seventh, or thirteenth aspect of the present invention, wherein the control means further receives a third original source signal and outputs a third controlled source signal, and further includes a third speaker for receiving the third controlled source signal and reproducing sound, wherein the control means decreases the magnitude of the second controlled source signal, increases the phase of the second controlled source signal, and increases the magnitudes and the phases of the first and third controlled source signals, as the distance between the pre-determined zone and the second speaker becomes larger.

The apparatus according to the seventeenth aspect of the present invention, as the listener recedes from the speakers, that is, the audible zone recedes from the speakers, generates an audible zone in the receded position by controlling the magnitude and phase of the source signal inputted to each speaker. That is, the apparatus according to the second aspect of the present invention, as the distance between the audible zone and the second speaker becomes larger, decreases the magnitude of the second controlled source signal inputted to the second speaker which is relatively near to the listener, increases the phase of the second controlled source signal, and increases the magnitudes and the phases of the first and third controlled source signals inputted to the first and third speaker which are relatively far to the listener to generate the audible zone in the receded position.

The inventors have investigated how the magnitude and the phase of source signal inputted to each speaker are controlled in case that the listener recedes from the speakers, that is, the audible zone recedes from the speakers. As a result, as the distance between the audible zone and the center of the speaker array becomes larger, the magnitude of the source signal inputted to the speaker which is relatively near to the listener is decreased, the magnitude of the source signal inputted to the speaker which is relatively far from the listener is increased, and the phases are increased overall.

Accordingly, the apparatus according to the seventeenth aspect of present invention, as the listener recedes from the speakers, can generate an audible zone in the receded position, and thus, can provide a sound environment in which only the person using the sound system enjoys the sound.

An apparatus according to a eighteenth aspect of the present invention includes the apparatus according to the first, seventh, or thirteenth aspect of the present invention, wherein the control means decreases the magnitude and the phase of the first controlled source signal, and increases the magnitude and the phase of the second controlled source signal, as the pre-determined zone becomes closer to the second speaker and farther from the first speaker.

The apparatus according to the eighteenth aspect of the present invention, as the listener moves from the one side speaker to the other side speaker, that is, the audible zone moves from the one side speaker to the other side speaker, generates an audible zone in the moved position by controlling the magnitude and phase of the source signal inputted to each speaker. That is, the apparatus according to a third aspect of the present invention, as the audible zone becomes closer to the second speaker and farther from the first speaker, decreases the magnitude and the phase of the first controlled source signal inputted to the first speaker which is relatively far to the listener, and increases the magnitude and the phase of the second controlled source signal inputted to the second speaker which is relatively near to the listener to generate the audible zone in the moved position.

The inventors have investigated how the magnitude and the phase of a source signal inputted to each speaker are controlled in a case in which the listener moves from the one side speaker to the other side speaker, that is, the audible zone moves from the one side speaker to the other side speaker. As the result, as the audible zone becomes closer to the second speaker and farther from the first speaker, the magnitude and phase of the source signal inputted to the speaker which is relatively far from the listener are decreased, and the magnitude and phase of the source signal inputted to the speaker which is relatively near to the listener are increased.

Accordingly, the apparatus according to the eighteenth aspect of present invention, as the listener moves from the one side speaker to the other side speaker, can generate the audible zone in the moved position, and thus, can provide a sound environment in which only the person using the sound system enjoys the sound.

An apparatus according to a nineteenth aspect of the present invention is an apparatus for reproducing sound from source signals, and includes a sound generating unit, a sensing unit, a signal analyzing unit, and a signal generating unit. The sound generating unit is for receiving source signals and reproducing sound, and has a plurality of speakers and a multi-channel audio amplifier which drives the plurality of speakers. The sensing unit is for sensing sound signals from the sound generating unit, and has a plurality of microphones, at least one of the microphones being installed in a pre-determined zone and another of the microphones being installed in a zone other than the pre-determined zone. The signal analyzing unit has a multi-channel signal analyzer that calculates a transfer function between the source signals received by the sound generating unit and the sound signals sensed by the sensing unit, and determines magnitudes and phases of the source signals received by the sound generating unit by using the transfer function so that a contrast between spatially averaged acoustic energy in a pre-determined zone and spatially averaged acoustic energy in total zone that includes the pre-determined zone and a zone other than the pre-determined zone is maximized. The signal generating unit has a multi-channel signal generator that receives information about the magnitudes and phases of the source signals being determined by the signal analyzing unit, generates a synchronized individual controlled source signals and transfers the synchronized individual controlled source signals to the plurality of speakers.

Accordingly, the apparatus according to the nineteenth aspect of the present invention can generate an audible zone and an inaudible zone, and provide a sound environment in which only the person using the sound system enjoys the sound.

A method according to a twentieth aspect of the present invention is a method for reproducing sound, and includes the steps of: Calculating a transfer function between source signals inputted to speaker and sound signals sensed in a pre-determined zone; Determining magnitudes and phases of the source signals by using the transfer function so that a contrast between spatially averaged acoustic energy in a pre-determined zone and spatially averaged acoustic energy in total zone that includes the pre-determined zone and a zone other than the pre-determined zone is maximized; and Reproducing sound by generating the source signals according to the determined magnitudes and phases and inputting the generated source signals to the speakers.

Accordingly, the apparatus according to the twentieth aspect of the present invention can generate an audible zone and an inaudible zone, and provide a sound environment in which only the person using the sound system enjoys the sound.

As described hereinabove, according to the present invention, since the optimized sound source signal for generating audible zone is obtained by using a transfer function which reflects the spatial characteristics of the acoustic space in which the sound system is installed, it is possible to maximize the relative difference between sound pressure levels in each zone within the acoustic space.

According to the present invention, since the acoustic brightness, which corresponds to the sound pressure level of the audible zone, is maximized when the total magnitude of input is limited, it is possible to make the sound environment in which the sound can be heard loudly in the zone where the listener exists.

According to the present invention, since the acoustic contrast between the audible zone and the inaudible zone (acoustic contrast 1) is maximized, it is possible to make a sound environment in which the sound can be heard loudly only in the zone where the listener exists. The acoustic contrast corresponds to the difference of the sound pressure level between two zones.

According to the present invention, since the acoustic contrast between the audible zone and the total acoustic space (acoustic contrast 2) is maximized, it is possible to make a sound environment in which the sound can be heard loudly only in the zone where the listener exists. The total acoustic space indicates the zone including audible and inaudible zone in this case.

DETAILED DESCRIPTION OF THE PREFERRED EMBODIMENTS

Above all, a theoretical background relating to the present invention is described in detail.

Figure 1:
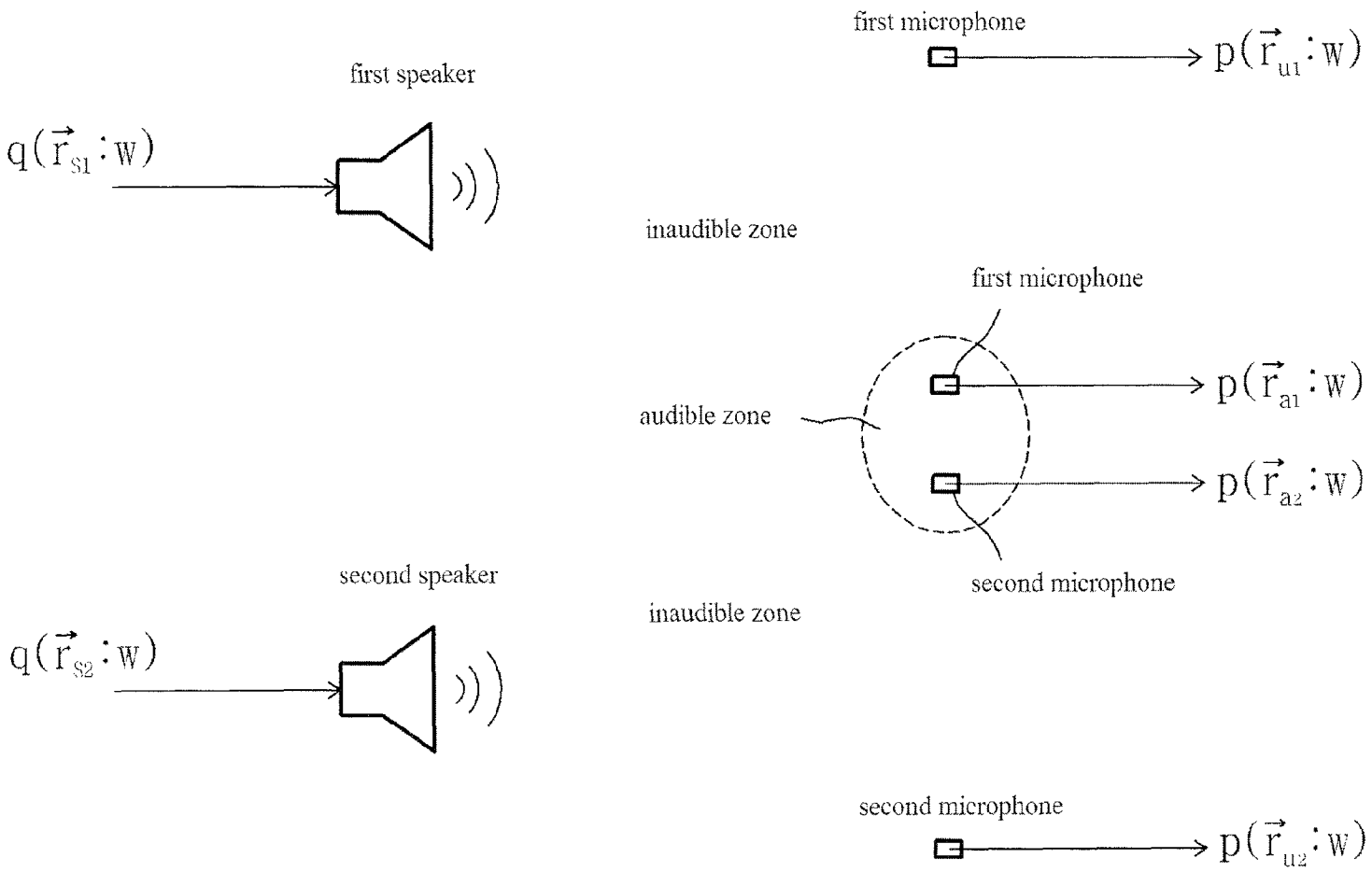
FIG. 1 is a schematic drawing for explaining the theoretical contents relating to the present invention.

FIG. 1 is a schematic drawing for explaining the theoretical contents relating to the present invention. FIG. 1 schematically shows an acoustic space. In the acoustic space, the first speaker and the second speaker are installed. The acoustic space is divided into a zone that is selected as an audible zone, where the listener exists (hereinafter, it is called the "audible zone"), and a zone other than audible zone, where the listener does not exist (hereinafter, it is called the "inaudible zone"). In FIG. 1, the audible zone and inaudible zone are schematically distinguished by the circular dotted line. The inaudible zone means practically the total zone other than the zone where the listener exists.

In the case in which there are the first sound source, the second sound source, . . . , and the Nth sound source in the acoustic space, the sound pressure ($p(\vec{r}_j|\vec{r}_{s,i};\omega)$), the signal which is sensed by a microphone at an arbitrary position ($\vec{r}_j$), the position where the microphone is installed within the acoustic space, which is generated by the first sound source, the second sound source, . . . , and the Nth sound source can be written as the following Equation 1.

$$p(\vec{r}_j|\vec{r}_{s,i};\omega)=\sum_{i=1}^{n} G(\vec{r}_j|\vec{r}_{s,i};\omega)q(\vec{r}_{s,i};\omega) \qquad \text{Equation 1}$$

Here, $q(\vec{r}_{s,i};\omega)$ is the signal which is inputted to the ith sound source that is located at the position of $\vec{r}_{s,i}$, and $G(\vec{r}_j|\vec{r}_{s,i};\omega)$ is a transfer function that represents the relation between $q(\vec{r}_{s,i};\omega)$ and $p(\vec{r}_j|\vec{r}_{s,i};\omega)$.

In the case of two sound sources and two microphones, the Equation 1 can be written as the following Equation 2 in matrix form.

$$\begin{bmatrix} p(\vec{r}_1;\omega) \\ p(\vec{r}_2;\omega) \end{bmatrix} = \begin{bmatrix} G(\vec{r}_1|\vec{r}_{s1};\omega) & G(\vec{r}_1|\vec{r}_{s2};\omega) \\ G(\vec{r}_2|\vec{r}_{s1};\omega) & G(\vec{r}_2|\vec{r}_{s2};\omega) \end{bmatrix} \begin{bmatrix} q(\vec{r}_{s1};\omega) \\ q(\vec{r}_{s2};\omega) \end{bmatrix} \qquad \text{Equation 2}$$

$$p = Gq$$

As shown in FIG. 1, in a case in which the sound sources are two (that is, i=1, 2), the positions in which the microphones are installed are two in the audible zone (that is, j=1, 2) and two in the inaudible zone, the matrix expressions are like the following Equations 3 and 4. In the Equations 3 and 4, the below subscripts a and u stand for the audible zone and the inaudible zone respectively.

$$\begin{bmatrix} p(\vec{r}_{a1};\omega) \\ p(\vec{r}_{a2};\omega) \end{bmatrix} = \begin{bmatrix} G(\vec{r}_{a1}|\vec{r}_{s1};\omega) & G(\vec{r}_{a1}|\vec{r}_{s2};\omega) \\ G(\vec{r}_{a2}|\vec{r}_{s1};\omega) & G(\vec{r}_{a2}|\vec{r}_{s2};\omega) \end{bmatrix} \begin{bmatrix} q(\vec{r}_{s1};\omega) \\ q(\vec{r}_{s2};\omega) \end{bmatrix} \qquad \text{Equation 3}$$

$$p_a = G_a q$$

$$\begin{bmatrix} p(\vec{r}_{u1};\omega) \\ p(\vec{r}_{u2};\omega) \end{bmatrix} = \begin{bmatrix} G(\vec{r}_{u1}|\vec{r}_{s1};\omega) & G(\vec{r}_{u1}|\vec{r}_{s2};\omega) \\ G(\vec{r}_{u2}|\vec{r}_{s1};\omega) & G(\vec{r}_{u2}|\vec{r}_{s2};\omega) \end{bmatrix} \begin{bmatrix} q(\vec{r}_{s1};\omega) \\ q(\vec{r}_{s2};\omega) \end{bmatrix} \qquad \text{Equation 4}$$

$$p_u = G_u q$$

The matrix expression about the acoustic space which includes all of the audible zone and the inaudible zone (hereinafter, it is called the "total zone") is like Equation 5. In the Equation 5, the below subscript t stands for the total zone.

$$\begin{bmatrix} p(\vec{r}_{a1};\omega) \\ p(\vec{r}_{a2};\omega) \\ p(\vec{r}_{u1};\omega) \\ p(\vec{r}_{u2};\omega) \end{bmatrix} = \begin{bmatrix} G(\vec{r}_{a1}|\vec{r}_{s1};\omega) & G(\vec{r}_{a1}|\vec{r}_{s2};\omega) \\ G(\vec{r}_{a2}|\vec{r}_{s1};\omega) & G(\vec{r}_{a2}|\vec{r}_{s2};\omega) \\ G(\vec{r}_{u1}|\vec{r}_{s1};\omega) & G(\vec{r}_{u1}|\vec{r}_{s2};\omega) \\ G(\vec{r}_{u2}|\vec{r}_{s1};\omega) & G(\vec{r}_{u2}|\vec{r}_{s2};\omega) \end{bmatrix} \begin{bmatrix} q(\vec{r}_{s1};\omega) \\ q(\vec{r}_{s2};\omega) \\ q(\vec{r}_{s1};\omega) \\ q(\vec{r}_{s2};\omega) \end{bmatrix} \qquad \text{Equation 5}$$

$$p_t = G_t q$$

And then, a representative physical quantity showing acoustic characteristics in an arbitrary zone must be defined. In the present invention, the physical quantity is defined as spatially averaged acoustic energy, and this can be written as the following Equation 6.

$$e = \frac{1}{2}p * p = q^H\left(\frac{1}{2}G^H G\right)q = q^H Rq \qquad \text{Equation 6}$$

(* is the conjugate operator.)

The reason that the representative physical quantity showing acoustic characteristics in an arbitrary zone is defined as spatially averaged acoustic energy is because it is not enough to show spatial acoustic characteristics in an arbitrary zone with only sound pressure level at each position. Therefore, in the present invention, the spatially averaged acoustic energy of the audible zone, the spatially averaged acoustic energy of the inaudible zone, and the spatially averaged acoustic energy of the total zone are considered as the sound pressure level in each zone.

In the Equation 6, matrix R is the correlation matrix representing a degree of interference that each sound source makes in an arbitrary zone and the number 2 represents the number of microphones installed in a certain zone. For easy understanding, the Equation 6 corresponds to a simple case in which the number of microphones is 2, but this can be changed by the number of microphones that are installed in an arbitrary zone.

On the basis of the Equation 6, each spatially averaged acoustic energy, that is sound pressure level of the audible zone, the inaudible zone, and the total zone can be written as the following Equations 7, 8, and 9 respectively.

$$e_a = q^H R_a q \qquad \text{Equation 7}$$

$$e_u = q^H R_u q \qquad \text{Equation 8}$$

$$e_t = q^H R_t q \quad \text{Equation 9}$$

Hereafter, how to determine the first controlled source signal and the second controlled source signal, which are necessary to generate the audible zone and the inaudible zone in acoustic space, using Equations 7, 8, and 9, which correspond to the sound pressure levels of the audible zone, inaudible zone, and total zone, will be described.

There are three kinds of methods. The first method is to determine the controlled source signal by maximizing the contrast between the sound pressure level of the audible zone and the given total magnitude of input. The second method is to determine the controlled source signal by maximizing the contrast between the sound pressure level of the audible zone and the sound pressure level of the inaudible zone. The third method is to determine the controlled source signal by maximizing the contrast between the sound pressure level of the audible zone and the sound pressure level of the total zone.

1. Determination of Controlled Source Signals for Maximizing the Contrast Between Sound Pressure Level of Audible Zone and the Given Total Magnitude of Input The total magnitude of input is defined as the sum of the squared absolute value of the complex magnitude of the first source signal and the squared absolute value of the complex magnitude of the second source signal, and this can be called control effort. The total magnitude of input is written as the following Equation 10.

$$\text{total magnitude of input} = |G_0|^2 q^H q \quad \text{Equation 10}$$

Here, $|G_0|^2$ is a normalizing constant to match with the dimension of acoustic energy.

The contrast between sound pressure level of audible zone and total magnitude of input can be written as the following Equation 11 by using the Equation 7 and 10, and this is defined as "acoustic brightness."

$$\alpha = \frac{q^H R_a q}{|G_0|^2 q^H q} \quad \text{Equation 11}$$

Accordingly, an equation to determine the controlled source signal for maximizing the contrast between the sound pressure level of audible zone and total magnitude of input to obtain the eigenvector that maximizes the Rayleigh quotient $\alpha$ can be written as the following Equation 12.

$$R_b q = \alpha |G_0|^2 q \quad \text{Equation 12}$$

In this case, the eigenvectors corresponding to the maximum eigenvalue are the first controlled source signal and the second controlled source signal.

2. Determination of Controlled Source Signals for Maximizing the Contrast Between the Sound Pressure Level of the Audible Zone and the Sound Pressure Level of the Inaudible Zone The contrast between the sound pressure level of the audible zone and the sound pressure level of the inaudible zone can be written as the following Equation 13 by using the Equations 7 and 8, and this is defined as "acoustic contrast 1."

$$\beta = \frac{q^H R_a q}{q^H R_u q} \quad \text{Equation 13}$$

Accordingly, an equation to determine controlled source signals for maximizing the contrast between the sound pressure level of the audible zone and the sound pressure level of the inaudible zone to obtain the eigenvector that maximizes the Rayleigh quotient $\beta$ can be written as the following Equation 14.

$$R_u^{-1} R_a q = \beta q \quad \text{Equation 14}$$

In this case, the eigenvectors corresponding to maximum eigenvalues are the first controlled source signal and the second controlled source signal.

3. Determination of Controlled Source Signals for Maximizing the Contrast Between the Sound Pressure Level of the Audible Zone and the Sound Pressure Level of the Total Zone The contrast between the sound pressure level of the audible zone and the sound pressure level of the total zone can be written as the following Equation 15 by using the Equation 7 and 9, and this is defined as "acoustic contrast 2."

$$\gamma = \frac{q^H R_a q}{q^H R_t q} \quad \text{Equation 15}$$

Accordingly, an equation to determine controlled source signals for maximizing the contrast between the sound pressure level of audible zone and the sound pressure level of total zone to obtain the eigenvector that maximizes the Rayleigh quotient $\gamma$ can be written as the following Equation 16.

$$R_t^{-1} R_a q = \gamma q \quad \text{Equation 16}$$

In this case, the eigenvectors corresponding to the maximum eigenvalue are the first controlled source signal and the second controlled source signal.

The methods related to the prior art have used the relation between a listener and sound source restrictively, but the present invention uses the method to obtain the optimized sound source signal by measuring transfer functions between a zone where the listener exits and sound sources.

So, the present invention, unlike the active noise control only reducing the sound pressure level at some designated positions, can enlarge the relative difference of the sound pressure level between zones within acoustic space. That is, the present invention performs a control to enlarge not only the magnitude of the sound pressure level corresponding to acoustic brightness but also the acoustic contrast between two zones being different with each other.

In the following, an embodiment according to the present invention is described based on the drawings.

Figure 2:
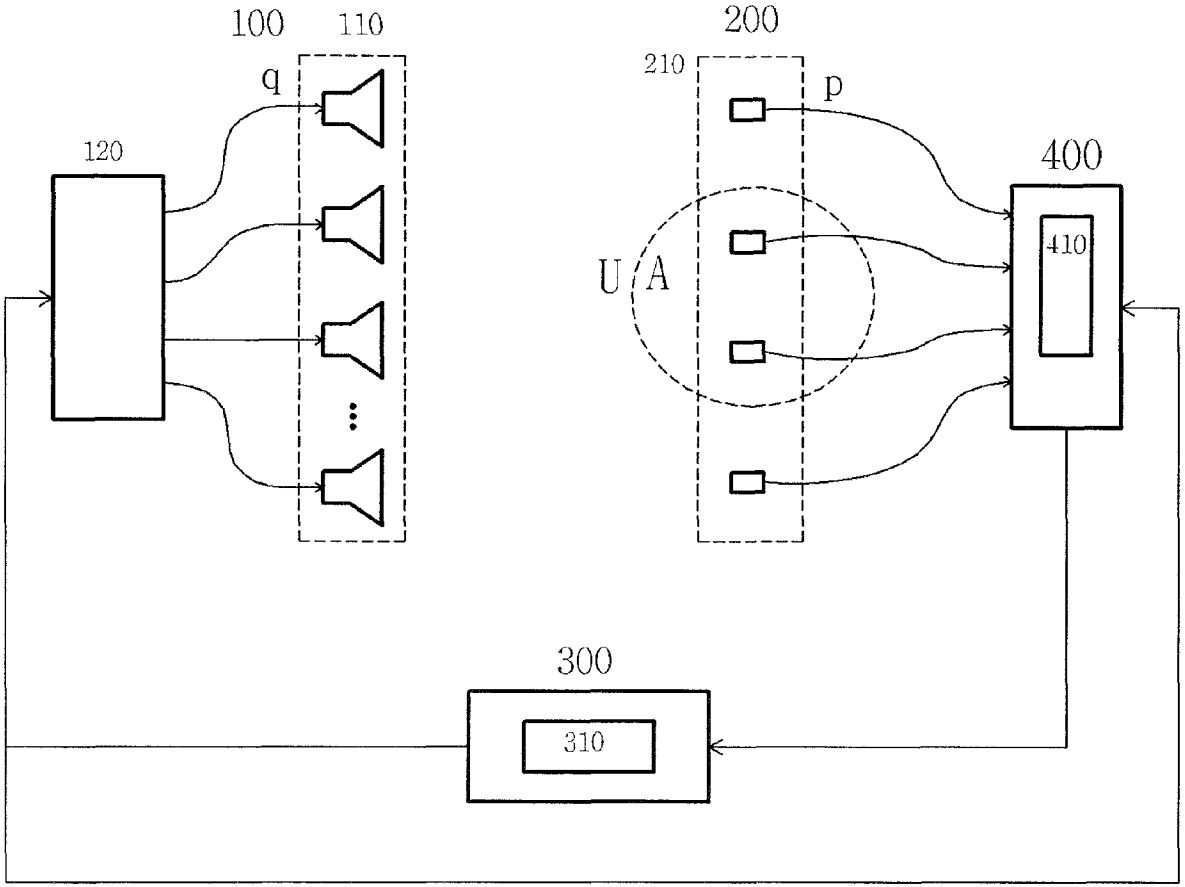
FIG. 2 is a schematic drawing of a sound system according to an embodiment of the present invention.

FIG. 2 is a schematic drawing of a sound system according to an embodiment of the present invention. As shown in FIG. 2, the sound system of the present invention has a sound generating unit 100, a sensing unit 200, a signal generating unit 300, and a signal analyzing unit 400. The sound source 100 includes a plurality of speakers corresponding to a plurality of sound sources and a multi channel audio amp 120 driving the plurality of speakers. The sensing unit 200 includes a plurality of microphones 210 installed in the audible zone and the inaudible zone. The signal generating unit 300 includes a multi channel signal generator 310 supplying each synchronized sound source signal to each speaker through the multi channel audio amp. The signal analyzing unit 400 includes a multi channel signal analyzer 410, which measures a transfer function between sound source signal q inputted to the sound generating unit 100 and sound signal p sensed by the sensing unit 200, determines a sound source signal for maximizing the acoustic brightness $\alpha$ of Equation 11 (acoustic brightness control), maximizing the acoustic contrast 1 $\beta$ Equation 13 (acoustic contrast 1 control), or maximizing the acoustic contrast 2 $\gamma$ of Equation 15 (acoustic contrast 2 control), and transmits the information about the determined sound source signal to the multi channel signal analyzer 410.

Figure 3:
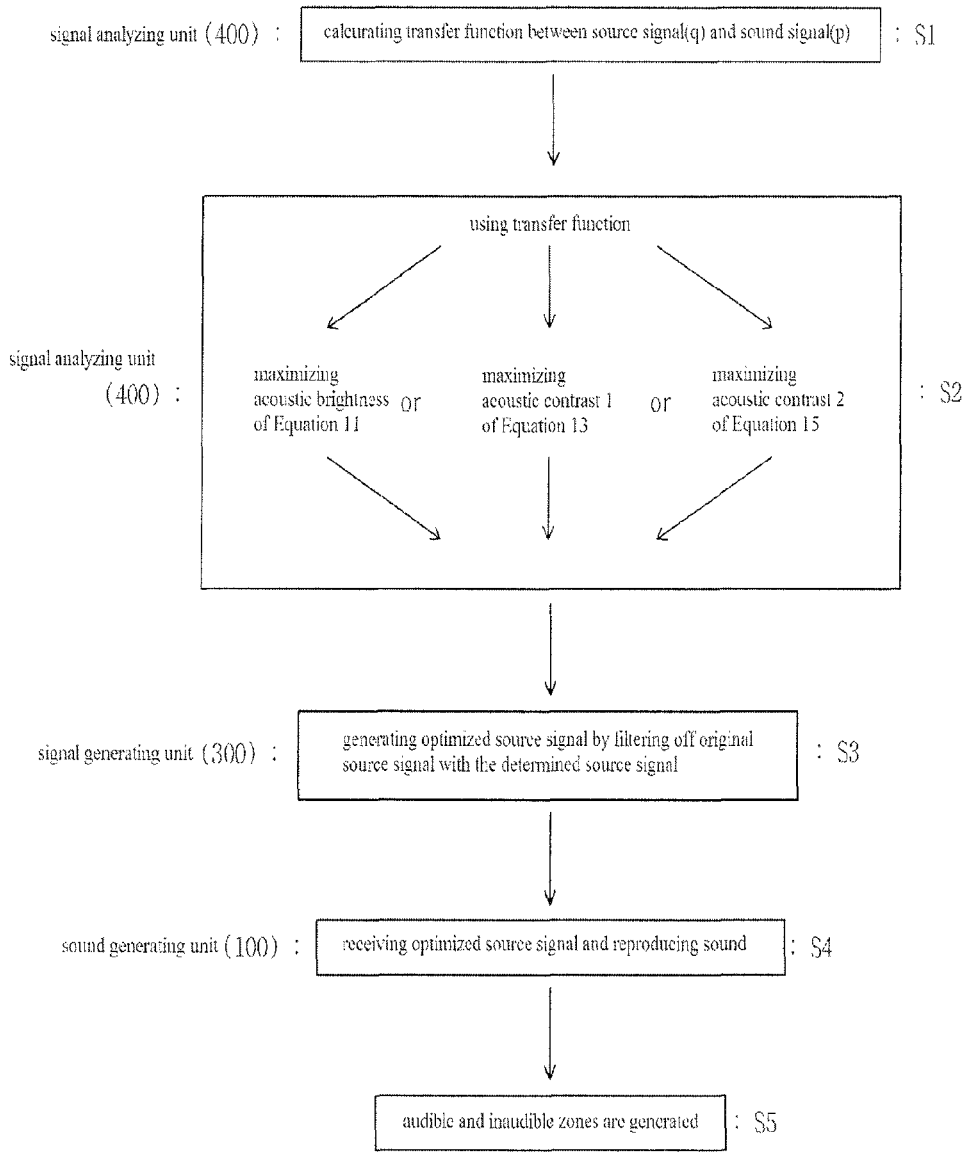
FIG. 3 is a flowchart illustrating the process of generating audible zone and inaudible zone within acoustic space by using the sound system of the present invention.

The process of generating the audible zone and the inaudible zone within acoustic space by using the sound system of the present invention is described referring to FIG. 3. FIG. 3 is a flowchart illustrating the process of generating the audible zone and the inaudible zone within acoustic space by using the sound system of the present invention.

Firstly, the signal analyzing unit 400 measures the transfer function between the sound source signal of the sound generating unit 100 and the sound signal of the sensing unit 200 (Step S1). In the measurement of the transfer function, a lot of measurements are necessary according to the number of the speakers and the microphones. So, the transfer function can be easily measured by a simple method that is generally used. The simple method is to measure the transfer function between the sound source signal of the sound generating unit and the sound signal of the sensing unit with only one measurement by inputting white noise to the plurality of speakers and identifying the contribution of each sound source to the sound signal sensed by each microphone.

And then, the signal analyzing unit 400 determines the magnitudes and phases of the source signals for maximizing the acoustic brightness $\alpha$ of Equation 11 (acoustic brightness control), maximizing the acoustic contrast 1 $\beta$ of Equation 13 (acoustic contrast 1 control), or maximizing the acoustic contrast 2 $\gamma$ of Equation 15 (acoustic contrast 2 control), and transmits the information about the determined magnitudes and phases of source signals to the signal generating unit 300 (Step S2).

Here, for clear understanding, the case of a single frequency excitation is described because the case of several frequencies can be considered as the combination of that of a single frequency excitation.

And then, the signal generating unit 300 receives the information about the magnitudes and phases of source signals determined by the signal analyzing unit 400, generates synchronized individual controlled source signals and transfers the synchronized individual controlled source signals to the sound generating unit 100 (Step S3). Here, the case of a single frequency excitation is described but it can be simply expanded to the case of several frequencies.

Practically, the magnitude ratio and phase difference between the determined source signal in the Step S2 and the original source signal function as a filter coefficient. For example, if there is an arbitrary original source signal that is desired to be heard, the arbitrary original source signal is filtered by the control means as an optimally controlled source signal in the Step S3.

And then, the sound generating unit 100 receives the optimally controlled source signals from the signal generating unit 300 and reproduces sound through the audio amplifiers and speakers (Step S4). Accordingly, in the acoustic space, the audible zone and the inaudible zone are generated (Step S5).

This sound system according to an embodiment of the present invention is applicable in various acoustic environments when the volume of the acoustic space, the install positions of the speakers, and the position of the listener are variable. This is because the present invention uses the measured transfer function that represents the relation between the original source signals and the measured signals by microphones. In other words, the effect of these changes of acoustic environment is included in the transfer function.

An exemplary product of the sound system according to the present invention can be considered. For example, if the sound system is a monitor with speakers, a position of a person using this monitor has been determined generally (a position being apart about 30~50 cm from the monitor), so, it can be said that the position of the audible zone has been already determined. And, since the monitor is equipped with speakers, it can be said that the relative position between the sound generating unit and the audible zone has been already determined. In this case, since the transfer function has been already determined, it can be said that the controlled source signal that is inputted to each speaker and optimized for generating the audible zone has been already determined. Accordingly, in this case, it is also good that the sensing unit and the signal analyzing unit are not included in the sound system.

The present invention can be applied to any product with speakers. That is, the present invention can be applied to a small-sized mobile product like a cellular phone, PDA, etc., a middle-sized product like a TV, and a big-sized product like an electric sign. In these products, if the relative position relation between the listener and the product has been already determined as described above, since the controlled source signal has been already determined, the product can be made without the sensing unit and the signal analyzing unit.

Figure 4:
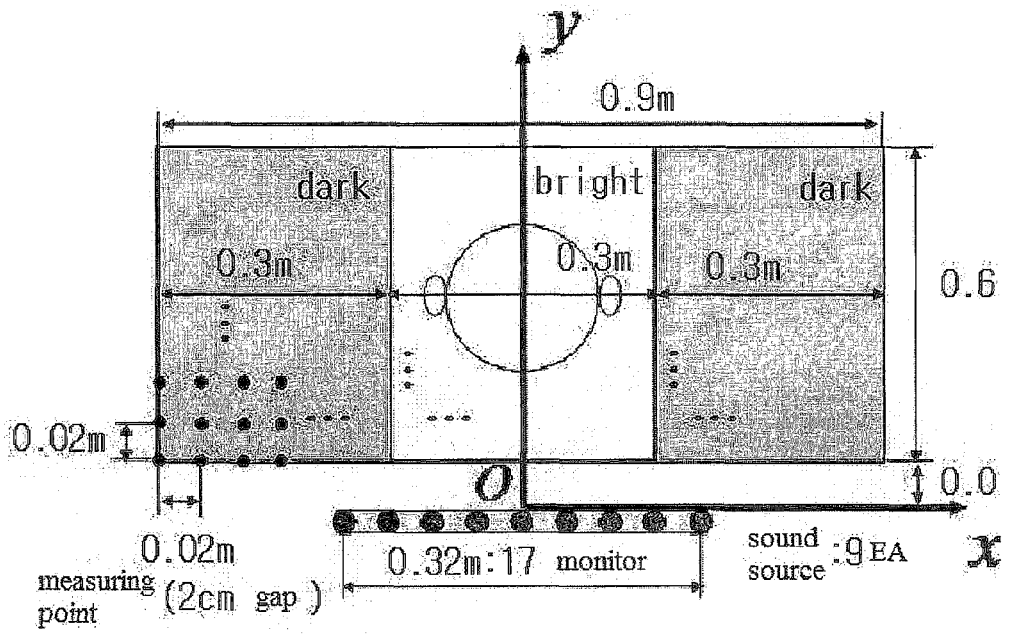
FIG. 4 is a schematic drawing illustrating an experimentally constructed acoustic space.

The inventors of the present invention applied the present invention experimentally and checked the action and the effect of the present invention. FIG. 4 is a schematic drawing illustrating an experimentally constructed acoustic space. As shown in FIG. 4, a plurality of sound sources is installed in the front side of a monitor in a line and forms a sound source array. An area surrounding the head of the listener is determined to be the audible zone, and other area is determined to be the inaudible zone. A multi channel audio amp, multi channel signal generator, multi channel signal analyzer, and etc are of course connected to the sound sources and the microphones. In FIG. 4, the area indicated by 'bright' is the audible zone and the area indicated by 'dark' is the inaudible zone.

The experimental devices applied to the acoustic space of FIG. 4 are as follows: a circular type speaker (Φ30) (made by Daelim audio Inc.) 9EA, a 12 channel sound card (Audiofire 12), a 16 channel audio amplifier (DBB16100), microphones being B&K type 4935 microphones (upper 5 kHz, dynamic range 140 dB) 23EA, and a data acquisition unit (National Instrument 8-channel module 4EA (PXI-4472))

The inventors demonstrated the feasibility of the present invention by applying the described three methods to this acoustic space. The procedure of the experiment is as follows: 1. microphone calibration, 2. installation of speakers and microphones at designated positions, 3. background noise measurement, 4. determination of the proper level of the original source signal by checking signal-to-noise ratio (more than 20 dB), 5. transfer function measurement (single frequency sound of 3 kHz, simultaneous measurement of each speaker input signal and each microphone output signal during 10 seconds with 16.384 kHz sampling rate), 6. determination of the optimal filter coefficient (or controlled source signal), and 7. playback of the optimally filtered source signal (3 kHz single tone).

Figure 5A:
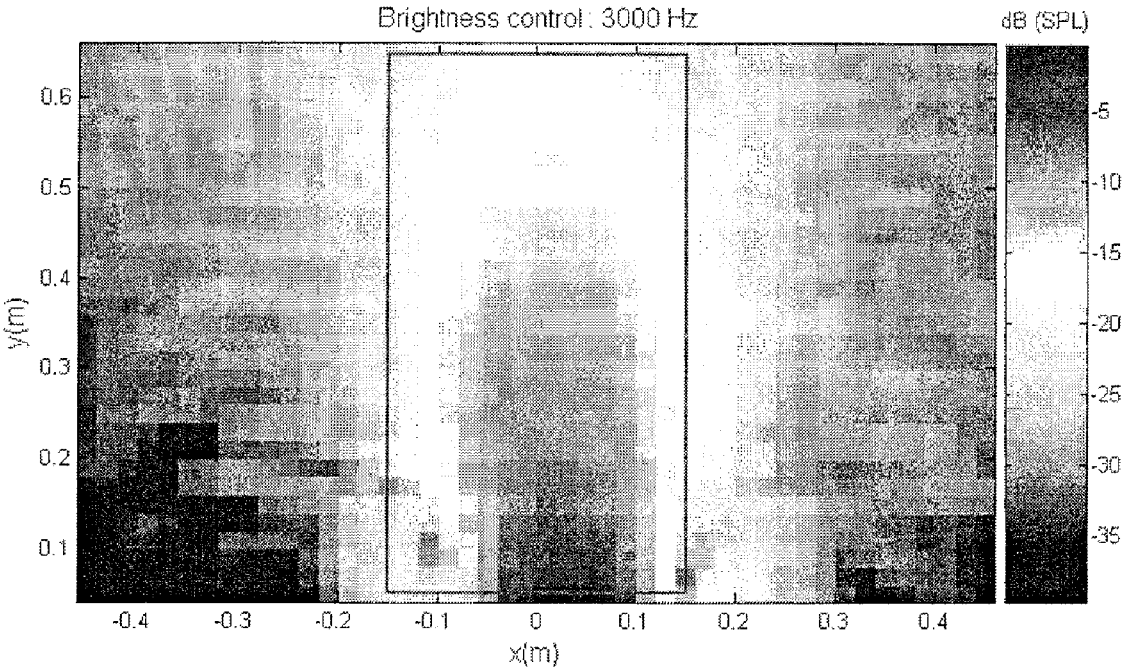
FIGS. 5(*a*) to 5(*c*) are drawings showing the sound pressure level distribution in audible zone for each control at 3 kHz, i.e. 5(*a*) acoustic brightness control, 5(*b*) acoustic contrast control 1, and 5(*c*) acoustic contrast control 2.
Figure 5B:
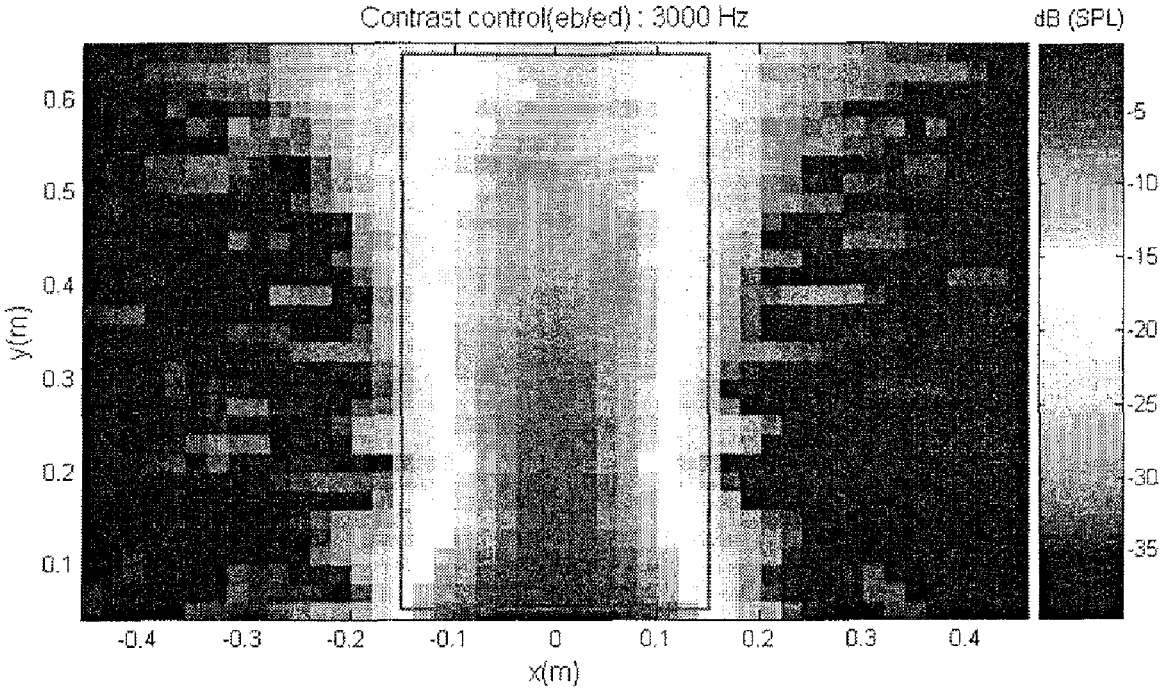
Figure 5C:
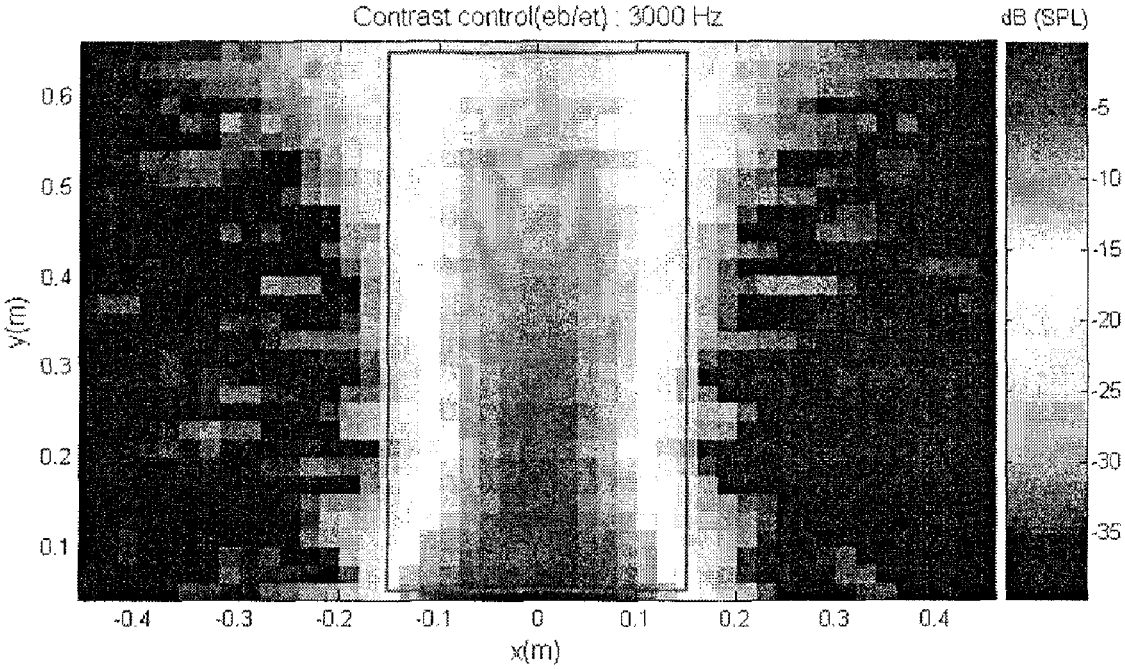

FIGS. 5(*a*) to 5(*c*) are drawings showing the sound pressure level distribution in the audible zone for each control at 3 kHz. FIG. 5(*a*) shows the result of the acoustic brightness control, FIG. 5(*b*) shows the result of the acoustic contrast 1 control, and FIG. 5(*c*) shows the result of the acoustic contrast 2 control. In FIGS. 5(*a*) to 5(*c*), the color scale stands for the sound pressure level; the red color or the medium shade means the maximum pressure level and the blue color or the darker shade means the minimum pressure level. As shown in FIGS. 5(*a*) to 5(*c*), if the present invention is applied to the acoustic space, it is possible to divide the acoustic space into the audible zone and the inaudible zone.

Figure 6A:
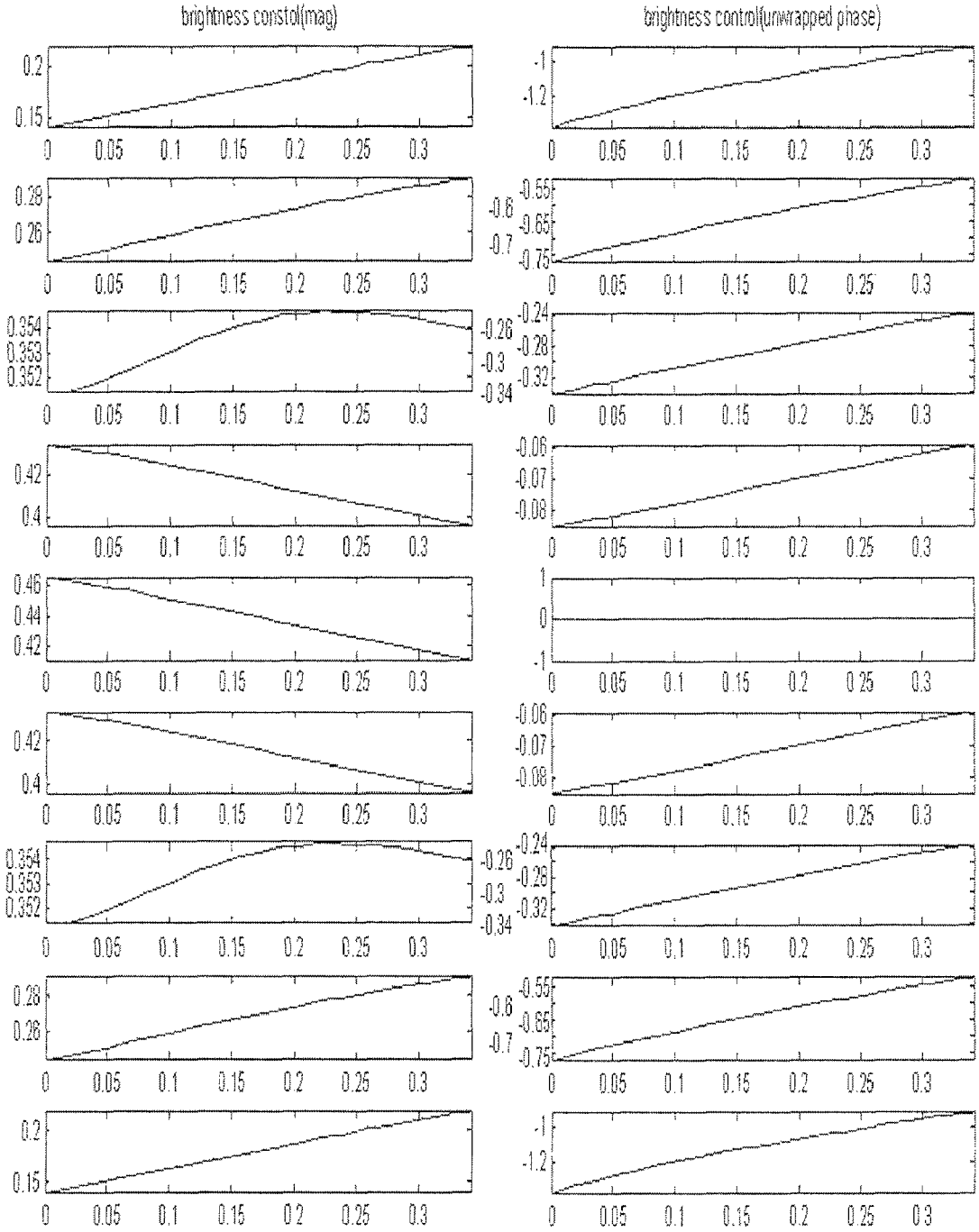
FIGS. 6(*a*) to 6(*c*) are drawings showing a tendency of how the magnitude and phase of controlled source signal inputted to each speaker changes in a case in which the audible zone is receded from the speakers.
Figure 6B:
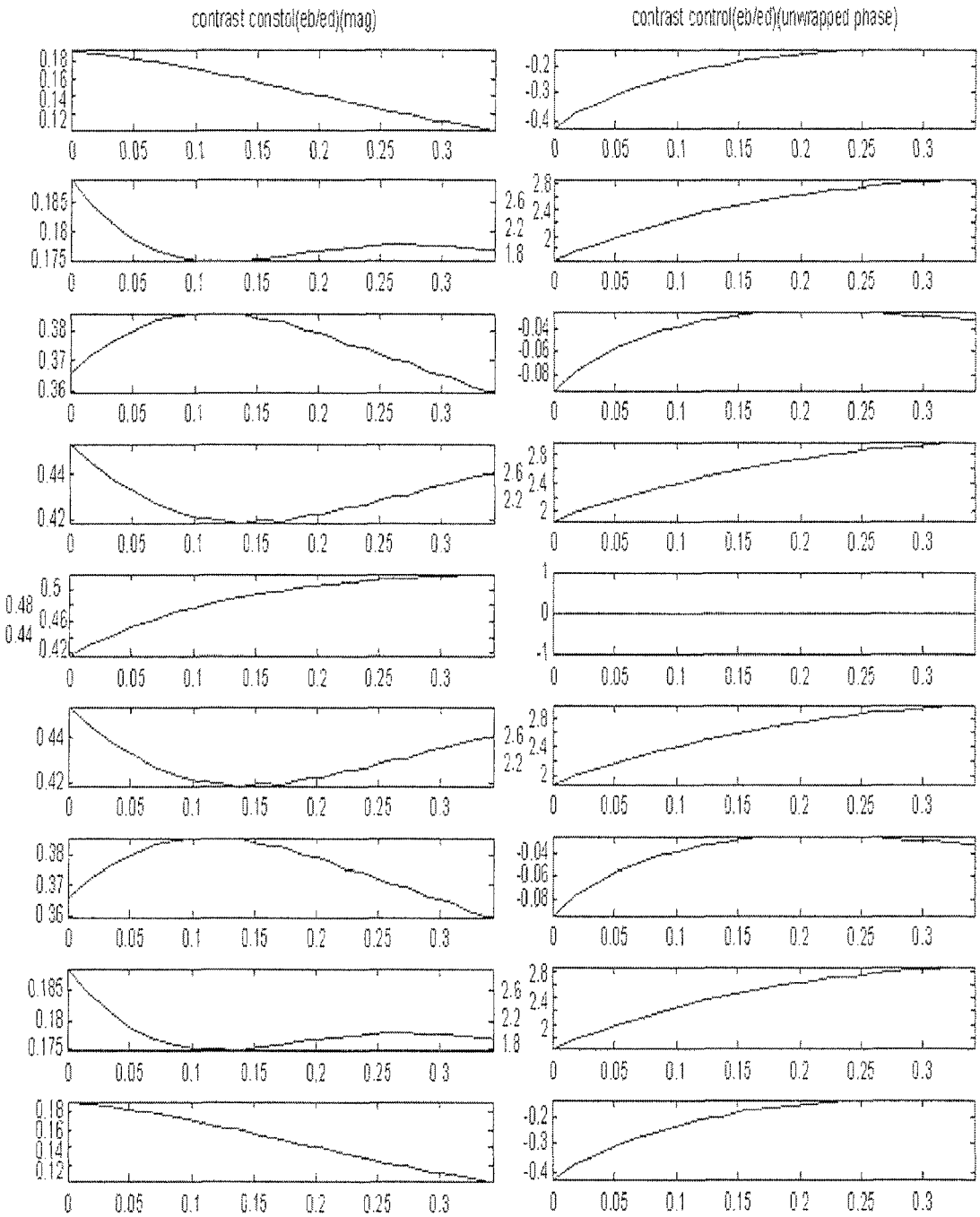
Figure 6C:
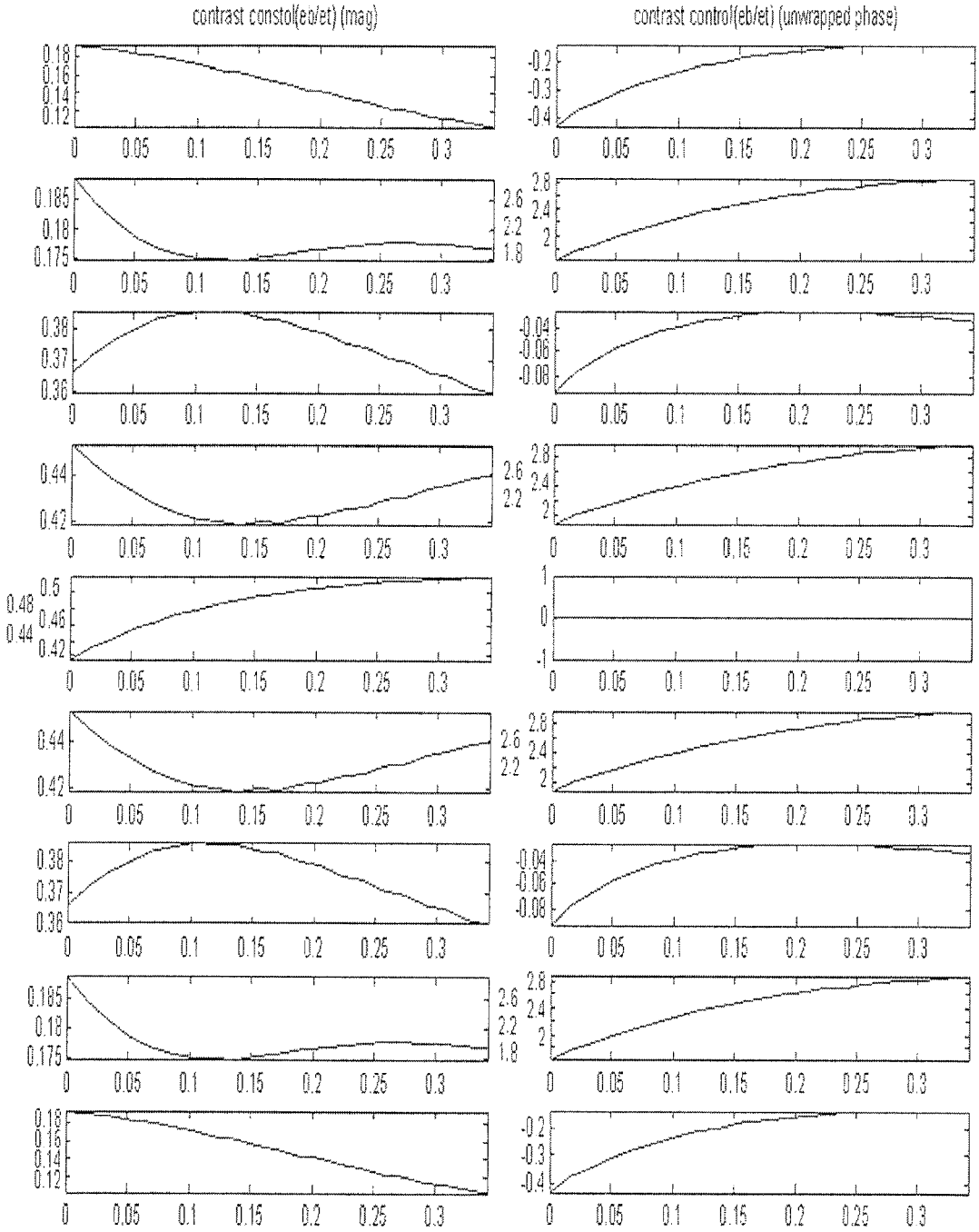

The inventors investigated through the computer simulation how the magnitude and the phase of source signal inputted to each speaker are controlled in case that the listener is receded from the speakers, that is, the audible zone recedes from the speakers. FIGS. 6(*a*) to 6(*c*) are drawings showing the tendency of how the magnitude and phase of controlled source signal inputted to each speaker change in a case in which the audible zone is receded from the speakers at 3 kHz.

In order to check the tendency of change of the source signal, the graph shows in the condition in which the phase of the source signal inputted to center speaker of the speaker array is set to zero, and the total sum of the magnitudes of the source signals is set to 1. FIG. 6(*a*) shows a result of the acoustic brightness control, 6(*b*) shows the result of the acoustic contrast 1 control, and FIG. 6(*c*) shows the result of the acoustic contrast 2 control. As shown in FIGS. 6(*a*) to 6(*c*), as the distance between the audible zone and the center of the speaker array becomes larger, the magnitude of the controlled source signal inputted to the speaker that is far from the center of the speaker array becomes larger, and the magnitude of the controlled source signal inputted to the speaker that is near from the center of the speaker array becomes smaller. And, in the case of the phases, as the distance between the audible zone and the center of the speaker array becomes larger, the phases increase overall.

The inventors checked how the magnitude and the phase of source signal inputted to each speaker is controlled in a case in which the listener moves from the left of the speaker array to the right of the speaker array, that is, the audible zone is moved from the left of the speaker array to the right of the speaker array.

Figure 7A:
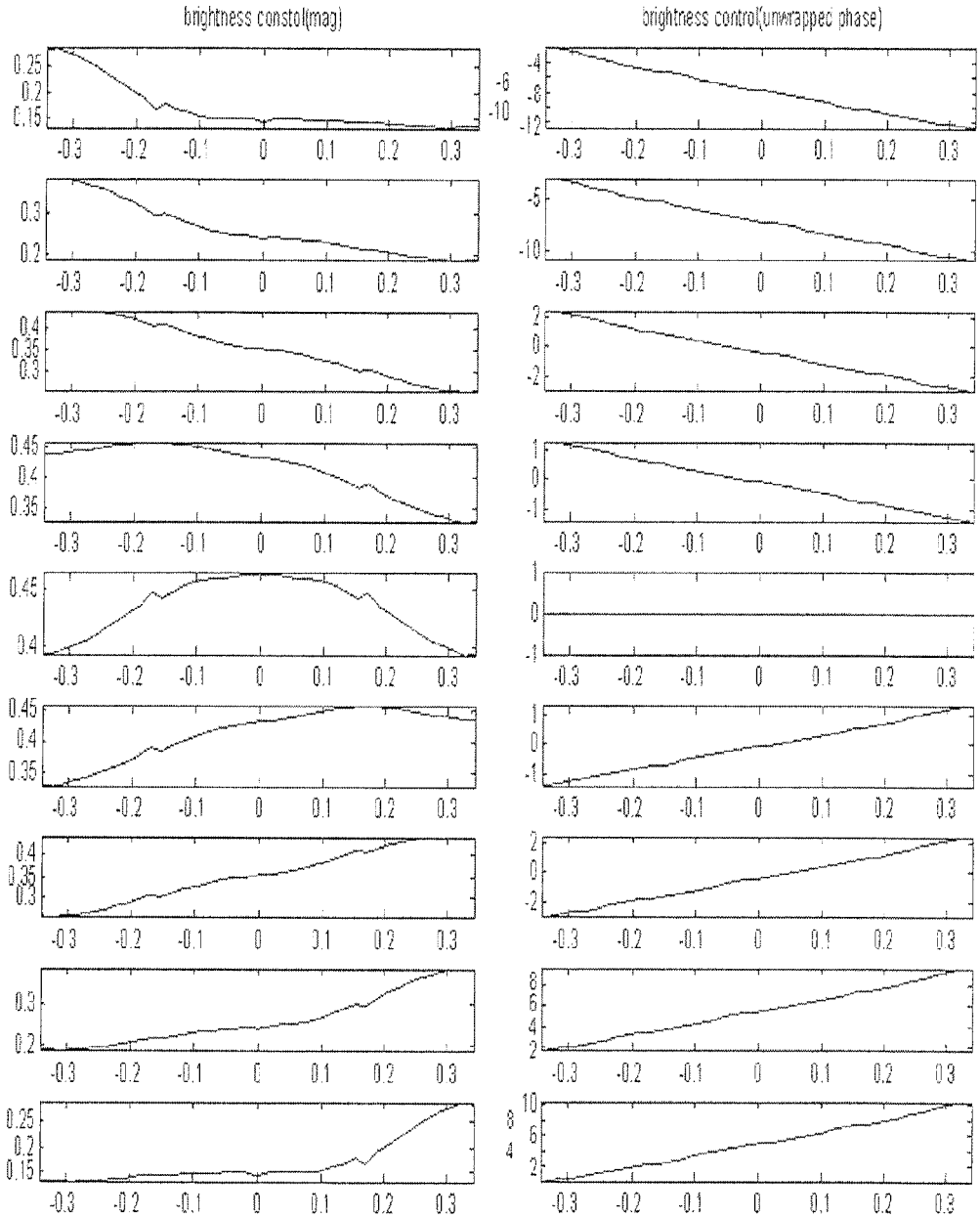
FIGS. 7(*a*) to 7(*c*) are drawings showing a tendency of how the magnitude and phase of controlled source signal inputted to each speaker changes in case that the audible zone is moved from the left of the speaker array to the right of the speaker array.
Figure 7B:
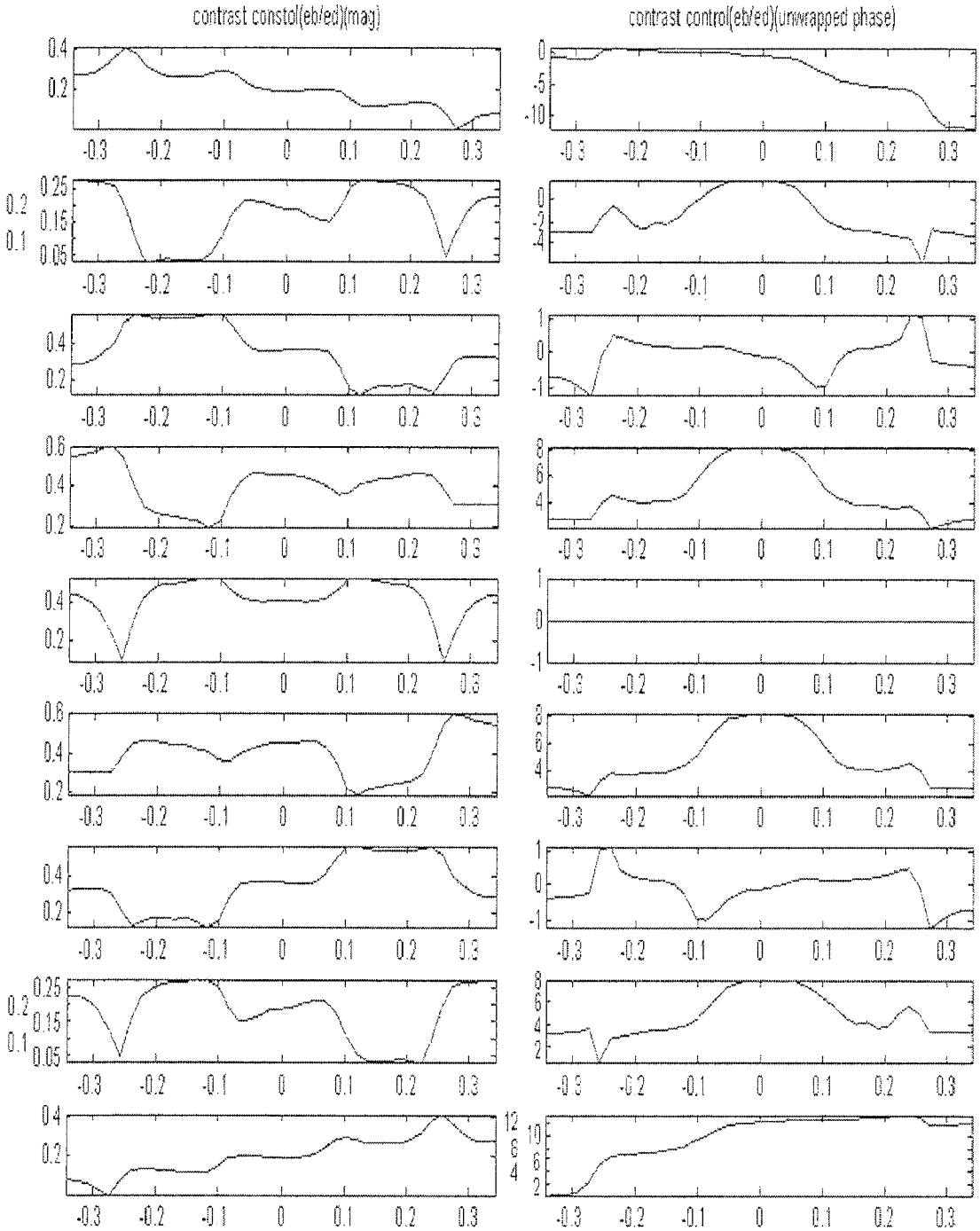
Figure 7C:
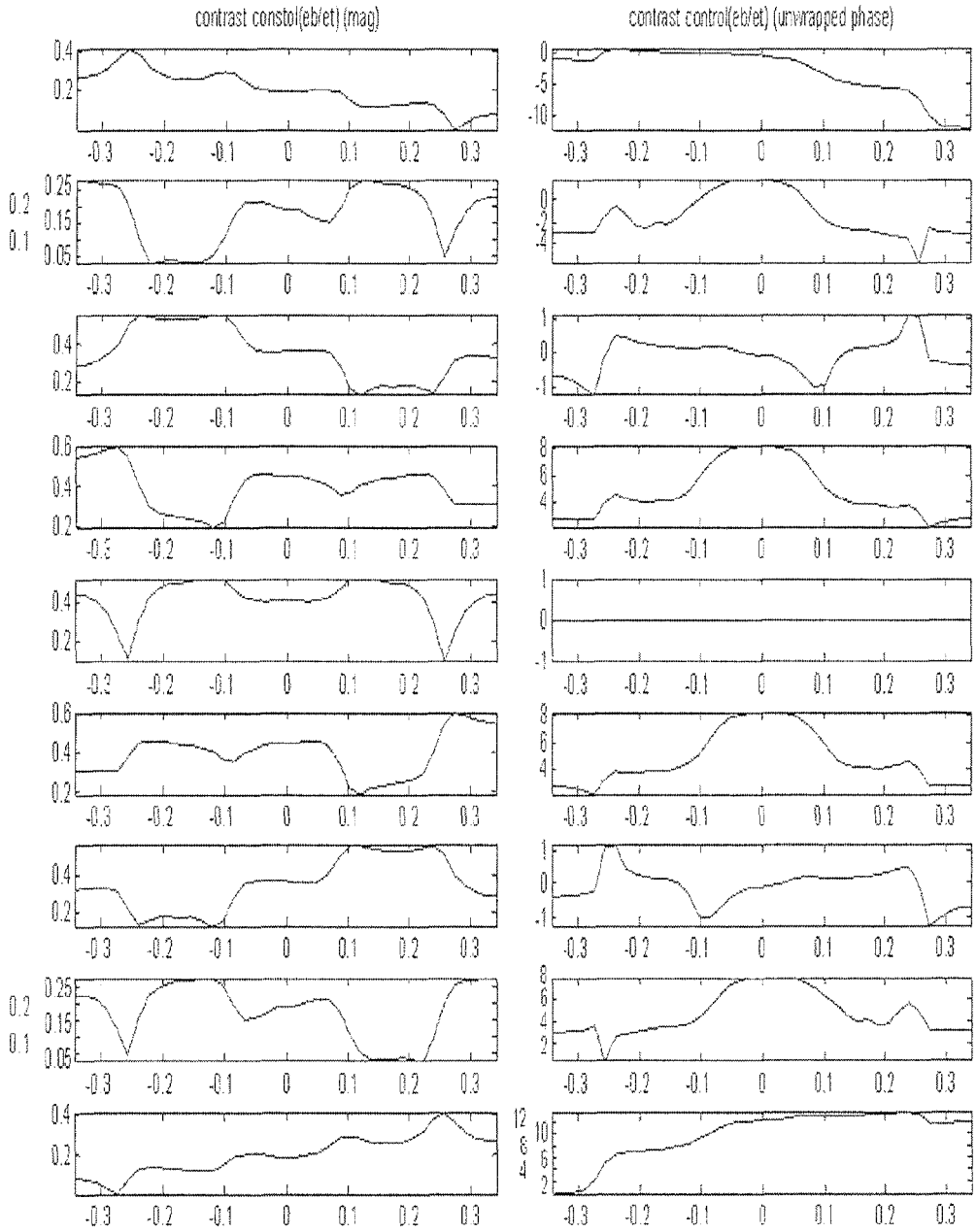

FIGS. 7(*a*) to 7(*c*) are drawings showing the tendency of how the magnitude and phase of the controlled source signal inputted to each speaker changes in the case in which the audible zone is moved from the left of the speaker array to the right of the speaker array at 3 kHz. FIG. 7(*a*) shows the result of the sound brightness control, FIG. 7(*b*) shows the result of the acoustic contrast 1 control, and FIG. 7(*c*) shows the result of the acoustic contrast 2 control. As shown in FIGS. 7(*a*) to 7(*c*), as the audible zone becomes closer to the right speakers of the speaker array and farther from the left speakers of the speaker array, the magnitudes and phases of the left speakers are decreased gradually, and the magnitudes and phases of the left speakers are increased gradually.

As described above, a technical composition of the present invention is to be understood that one skilled in the art is not to modify a technical idea or an essential feature of the present invention but to take effect as the other concrete embodiments.

Therefore, it is to be understood that embodiments described above are not qualifying but exemplary in all points. Also, the scope of the present invention will be included in the following claims than above detail explanation, and it is to be analyzed that the meaning and scope of the claims and all changes deducted from equivalent arrangements or modifications included within the scope of the present invention.

The present invention is applicable to any sound device. The sound device can be a small-sized mobile product like a cellular phone, PDA, etc., a middle-sized product like a TV, and a big-sized product like an electric sign. With the application of the present invention, it is possible to ensure that only the person using the sound device can hear the sound from the sound device and to generate a private acoustic space. Thus, an accessory for private listening like ear phone, head phone, etc is unnecessary.

What is claimed is:

1. An apparatus for reproducing sound from original source signals, comprising:

a control device configured to receive first and second original source signals, to control magnitudes and phases of the received first and second original source signals to increase a ratio of a level of spatially averaged acoustic energy in a pre-determined zone to a sum of energies of the first and second original source signals, and to output first and second controlled source signals;

a first speaker configured to receive the first controlled source signal and to reproduce sound; and a second speaker configured to receive the second controlled source signal and to reproduce sound.

2. The apparatus for reproducing sound according to claim 1, wherein the magnitudes and phases of the first and the second controlled source signals have been controlled so that the ratio is increased.

3. The apparatus for reproducing sound according to claim 2, wherein the apparatus is a monitor that is fitted with the first speaker and the second speaker.

4. The apparatus for reproducing sound according to claim 2, wherein the apparatus is a mobile phone that is fitted with the first speaker and the second speaker .

5. The apparatus for reproducing sound according to claim 1, further comprising a third speaker, wherein the control device is configured to receive a third original source signal and to output a third controlled source signal, the third speaker is configured to receive the third controlled source signal and to reproduce sound, and the control device decreases the magnitude of the second controlled source signal, increases the phase of the second controlled source signal, and increases the magnitudes and the phases of the first and third controlled source signals as the distance between the pre-determined zone and the second speaker becomes larger.

6. The apparatus for reproducing sound according to claim 1, wherein the control device decreases the magnitude and the phase of the first controlled source signal, and increases the magnitude and the phase of the second controlled source signal, as the pre-determined zone moves closer to the second speaker and farther from the first speaker.

7. An apparatus for reproducing sound from source signals, comprising:

a sound generating unit configured to receive source signals and to reproduce sound, having a plurality of speakers and a multi-channel audio amplifier configured to drive the plurality of speakers;

a sensing unit configured to sense sound signals from the sound generating unit, having a plurality of microphones, at least one of the microphones being installed in a pre-determined zone and another of the microphones being installed in a zone other than the pre-determined zone;

a signal analyzing unit having a multi-channel signal analyzer that calculates a transfer function between the source signals received by the sound generating unit and the sound signals sensed by the sensing unit, and determines magnitudes and phases of the source signals received by the sound generating unit by using the transfer function to increase a contrast between spatially averaged acoustic energy in a pre-determined zone and sum of energies of the first and second original source signals; and a signal generating unit having a multi-channel signal generator that receives information about the magnitudes and phases of the source signal being determined by the signal analyzing unit, generates synchronized individual controlled source signals, and transfers the synchronized individual controlled source signals to the plurality of speakers.

8. A method for reproducing sound, comprising:

calculating a transfer function between source signals inputted to speakers and sound signals sensed in a pre-determined zone;

determining magnitudes and phases of the source signals by using the transfer function to increase a contrast between spatially averaged acoustic energy in the pre-determined zone and a sum of energies of the first and second original source signals; and reproducing sound by generating the source signals according to the determined magnitude and phase and inputting the generated source signals to the speakers.

9. An apparatus for reproducing sound from original source signals, comprising:

a control device configured to receive first and second original source signals, to control magnitudes and phases of the received first and second original source signals to increase a ratio of a level of spatially averaged acoustic energy in a pre-determined zone to spatially averaged acoustic energy in a zone other than the pre-determined zone, and to output first and second controlled source signals;

a first speaker configured to receive the first controlled source signal and to reproduce sound; and a second speaker configured to receive the second controlled source signal and to reproduce sound.

10. The apparatus for reproducing sound according to claim 9, wherein the magnitudes and phases of the first and the second controlled source signals have been controlled so that the ratio is increased.

11. The apparatus for reproducing sound according to claim 10, wherein the apparatus is a monitor that is fitted with the first speaker and the second speaker.

12. The apparatus for reproducing sound according to claim 10, wherein the apparatus is a mobile phone that is fitted with the first speaker and the second speaker.

13. The apparatus for reproducing sound according to claim 9, further comprising a third speaker, wherein the control device is configured to receive a third original source signal and to output a third controlled source signal, the third speaker is configured to receive the third controlled source signal and to reproduce sound, and the control device decreases the magnitude of the second controlled source signal, increases the phase of the second controlled source signal, and increases the magnitudes and the phases of the first and third controlled source signals as the distance between the pre-determined zone and the second speaker becomes larger.

14. The apparatus for reproducing sound according to claim 9, wherein the control device decreases the magnitude and the phase of the first controlled source signal, and increases the magnitude and the phase of the second controlled source signal, as the pre-determined zone moves closer to the second speaker and farther from the first speaker.

15. An apparatus for reproducing sound from source signals, comprising:

a sound generating unit configured to receive source signals and to reproduce sound, having a plurality of speakers and a multi-channel audio amplifier that drives the plurality of speakers;

a sensing unit configured to sense sound signals from the sound generating unit, having a plurality of microphones, at least one of the microphones being installed in a pre-determine zone and another of the microphones being installed in a zone other than the pre-determined zone;

a signal analyzing unit having a multi-channel signal analyzer that calculates a transfer function between the source signals received by the sound generating unit and the sound signals sensed by the sensing unit, and determines magnitudes and phases of the source signals received by the sound generating unit by using the transfer function to increase a contrast between spatially averaged acoustic energy in a pre-determined zone and spatially averaged acoustic energy in a zone other than the pre-determined zone; and a signal generating unit having a multi-channel signal generator that receives information about the magnitudes and phases of the source signal being determined by the signal analyzing unit, generates synchronized individual controlled source signals, and transfers the synchronized individual controlled source signals to the plurality of speakers.

16. A method for reproducing sound, comprising:

calculating a transfer function between source signals inputted to speakers and sound signals sensed in a pre-determined zone;

determining magnitudes and phases of the source signals by using the transfer function to increase a contrast between spatially averaged acoustic energy in a pre-determined zone and spatially averaged acoustic energy in a zone other than the pre-determined zone; and reproducing sound by generating the source signals according to the determined magnitude and phase and inputting the generated source signals to the speakers.

17. An apparatus for reproducing sound from original source signals, comprising:

a control device configured to receive first and second original source signals, to control magnitudes and phases of the received first and second original source signals to increase a ratio of a level of spatially averaged acoustic energy in a pre-determined zone to spatially averaged acoustic energy in a total zone that includes the pre-determined zone and a zone other than the pre-determined zone, and to output first and second controlled source signals;

a first speaker configured to receive the first controlled source signal and to reproduce sound; and a second speaker configured to receive the second controlled source signal and to reproduce sound.

18. The apparatus for reproducing sound according to claim 17, wherein the magnitudes and phases of the first and the second controlled source signals have been controlled signals so that the ratio is increased.

19. The apparatus for reproducing sound according to claim 18, wherein the apparatus is a monitor that is fitted with the first speaker and the second speaker.

20. The apparatus for reproducing sound according to claim 18, wherein the apparatus is a mobile phone that is fitted with the first speaker and the second speaker.

21. The apparatus for reproducing sound according to claim 17, further comprising a third speaker, wherein the control device is configured to receive a third original source signal and to output a third controlled source signal, the third speaker is configured to receive the third controlled source signal and to reproduce sound, and the control device decreases the magnitude of the second controlled source signal, increases the phase of the second controlled source signal, and increases the magnitudes and the phases of the first and third controlled source signals as the distance between the pre-determined zone and the second speaker becomes larger.

22. The apparatus for reproducing sound according to claim 17, wherein the control device decreases the magnitude and the phase of the first controlled source signal, and increases the magnitude and the phase of the second controlled source signal, as the pre-determined zone moves closer to the second speaker and farther from the first speaker.

23. An apparatus for reproducing sound from source signals, comprising:

a sound generating unit configured to receive source signals and to reproduce sound, having a plurality of speakers and a multi-channel audio amplifier which drives the plurality of speakers;

a sensing unit configured to sense sound signals from the sound generating unit, having a plurality of microphones, at least one of the microphones being installed in a pre-determined zone and the other of the microphones being installed in a zone other than the pre-determined zone;

a signal analyzing unit having a multi-channel signal analyzer that calculates a transfer function between the source signals received by the sound generating unit and the sound signals sensed by the sensing unit, and determines magnitudes and phases of the source signals received by the sound generating unit by using the transfer function signals to increase a contrast between spatially averaged acoustic energy in a pre-determined zone and spatially averaged acoustic energy in total zone that includes the pre-determined zone and a zone other than the pre-determined zone; and a signal generating unit having a multi-channel signal generator that receives information about the magnitudes and phases of the source signal being determined by the signal analyzing unit, generates synchronized individual controlled source signals, and transfers the synchronized individual controlled source signals to the plurality of speakers.

24. A method for reproducing sound, comprising:

calculating a transfer function between source signals inputted to speakers and sound signals sensed in a pre-determined zone;

determining magnitudes and phases of the source signals by using the transfer function signals to increase a contrast between spatially averaged acoustic energy in a pre-determined zone and spatially averaged acoustic energy in total zone that includes the pre-determined zone and a zone other than the pre-determined zone; and reproducing sound by generating the source signals according to the determined magnitude and phase and inputting the generated source signals to the speakers.

* * * * *